US009752323B2

(12) United States Patent
Sacks et al.

(10) Patent No.: US 9,752,323 B2
(45) Date of Patent: Sep. 5, 2017

(54) LIGHT-WEIGHT METAL STUD AND METHOD OF MANUFACTURE

(71) Applicant: Sacks Industrial Corporation, Vancouver (CA)

(72) Inventors: Abraham Jacob Sacks, Vancouver (CA); William Spilchen, White Rock (CA); Jeffrey Leonard Sacks, Vancouver (CA)

(73) Assignee: Sacks Industrial Corporation, Vancouver (CA)

( * ) Notice: Subject to any disclaimer, the term of this patent is extended or adjusted under 35 U.S.C. 154(b) by 0 days.

(21) Appl. No.: 14/812,952

(22) Filed: Jul. 29, 2015

(65) Prior Publication Data

US 2017/0030080 A1 Feb. 2, 2017

(51) Int. Cl.
*E04C 3/00* (2006.01)
*E04C 3/32* (2006.01)
(Continued)

(52) U.S. Cl.
CPC ..... *E04C 3/32* (2013.01); *E04C 5/065* (2013.01); *E04B 2/62* (2013.01); *E04C 2003/0491* (2013.01)

(58) Field of Classification Search
CPC ..... E04C 3/32; E04C 3/08; E04C 3/09; E04C 2003/0413; E04C 2003/0473;
(Continued)

(56) References Cited

U.S. PATENT DOCUMENTS 320,163 A 6/1885 On
528,931 A 11/1894 Eils
(Continued)

FOREIGN PATENT DOCUMENTS

CA 2 391 269 A1 1/2003
CA 2 652 919 A1 5/2010
(Continued)

OTHER PUBLICATIONS

Andrade et al., "Lateral-torsional buckling of singly symmetric web-tapered thin-walled I-beams: 1D model vs. shell FEA," *Computers and Structures* 85:1343-1359, 2007.
(Continued)

*Primary Examiner* — Brian Mattei
(74) *Attorney, Agent, or Firm* — Seed IP Law Group LLP

(57) ABSTRACT

A light-weight metal framing member includes a metal stud and reinforcement plate(s), and method to produce a light-weight metal framing member may include forming a pair of channel members each having a respective major face having a respective first edge, and reinforcing such with one or more reinforcement plates, preferably at opposed ends thereof. Each member includes first and second flanges extending along the respective major face. A wire matrix includes a pair of wires each having apexes alternatively physically attached to the pair of channel members. The wire matrix forms longitudinal passages to support utility lines and position the lines away from the pair of channel members. The apexes are secured to flanges of the pair of channel members to strengthen the stud and reduce weight.

19 Claims, 13 Drawing Sheets

(51) Int. Cl.
*E04C 5/065* (2006.01)
*E04C 3/04* (2006.01)
*E04B 2/62* (2006.01)

(58) Field of Classification Search
CPC ..... E04C 2003/0482; E04C 2003/0491; E04C 3/292; E04C 2003/0486; E04C 3/07; E04C 2003/0421; E04B 5/10; E04B 2/7412; E04B 2/60; E04B 2/789
See application file for complete search history.

(56) References Cited

U.S. PATENT DOCUMENTS 553,306 A 1/1896 Fordyce
600,352 A 3/1898 Bell
617,458 A 1/1899 Clancy
651,590 A 6/1900 Brightman
659,416 A 10/1900 Perry
D35,386 S 12/1901 Reid
749,714 A 1/1904 Barnes et al.
729,039 A 6/1905 Hollinger
930,350 A 8/1909 Clark
934,081 A 9/1909 Marks
945,656 A 1/1910 White
948,414 A 2/1910 Clark
987,374 A 3/1911 Kahn
1,059,710 A 4/1913 Chess, Jr.
1,087,511 A 2/1914 Scammell
1,146,999 A 7/1915 Burk
1,147,000 A 7/1915 Burk
1,276,764 A 8/1918 Holbrook, Sr.
1,314,777 A 9/1919 White
1,363,018 A 12/1920 Sexton
1,372,741 A 3/1921 Dickinson
1,405,579 A 2/1922 Graham
1,419,709 A 6/1922 Ackermann
1,434,915 A 11/1922 Scholfield
1,436,866 A 11/1922 Dickinson
1,537,588 A 5/1925 Curtis
1,591,858 A 7/1926 McClintic
1,637,410 A 8/1927 Coryell
1,641,872 A 9/1927 Southwell
1,655,091 A 1/1928 Curtis
1,691,227 A 11/1928 Cross
1,701,125 A 2/1929 Sagendorph
1,704,608 A 3/1929 Humphris
1,743,800 A 1/1930 Pearce
1,767,814 A 6/1930 Reynolds
1,769,361 A 7/1930 Warren
1,801,530 A 4/1931 Overmire
1,802,779 A 4/1931 Quade
1,824,082 A 9/1931 Hernandez
1,837,393 A 12/1931 Arey
1,885,343 A 11/1932 Greulich
1,897,842 A 2/1933 Herbest, Jr.
1,963,395 A 6/1934 Zabriskie
1,964,403 A 6/1934 Loucks
1,976,395 A 10/1934 Herbest, Jr.
1,986,171 A 1/1935 Wilson
1,986,172 A 1/1935 Wilson
1,993,432 A 3/1935 Boyle
2,022,363 A 11/1935 Vertuno
2,089,023 A * 8/1937 Hahn ..... E04C 3/09 52/690
2,099,709 A 11/1937 Spinosa
2,101,074 A * 12/1937 Kotrbaty ..... E04B 2/60 52/220.2
2,116,668 A 5/1938 Cross
2,121,962 A * 6/1938 Glass ..... E04B 2/845 181/295
2,131,670 A 9/1938 Redding et al.
2,136,071 A * 11/1938 Braden ..... E04C 3/09 52/694
2,141,400 A 12/1938 Mack
2,150,606 A 3/1939 McLellan
2,180,486 A * 11/1939 Tench ..... E04C 3/08 219/58
2,184,353 A 12/1939 Leary
2,218,007 A 10/1940 Miller
2,219,806 A 10/1940 Buttress
2,236,141 A 3/1941 Karelius
2,241,991 A 5/1941 Goldsmith
2,243,723 A 5/1941 Tench
2,256,394 A 9/1941 Lamel
2,267,401 A 12/1941 Gilmore
2,269,869 A 1/1942 Specht
2,315,687 A 4/1943 Burke
2,322,654 A 6/1943 Moore
2,322,657 A 6/1943 Olsen
2,375,303 A 5/1945 Karelius
2,455,666 A 12/1948 Fournier
2,474,778 A 6/1949 Cross
2,501,699 A 3/1950 Stecker
2,565,292 A 8/1951 Arthur
2,572,483 A 10/1951 Howle
2,595,465 A 5/1952 Keene et al.
2,605,867 A 8/1952 Goodwin
2,621,160 A 12/1952 Johnson et al.
2,639,269 A 5/1953 Dube
2,645,824 A 7/1953 Titsworth
2,645,930 A 7/1953 Stockton
2,650,171 A 8/1953 Schaaf
2,668,606 A * 2/1954 King ..... E04C 3/08 52/691
2,824,022 A 2/1958 Sucetti
2,903,880 A 9/1959 Johnson
2,929,239 A 3/1960 Dahlhauser et al.
2,936,051 A * 5/1960 Martin ..... E04B 1/24 52/650.1
2,996,160 A 8/1961 Voight
3,070,198 A 12/1962 Haskell
3,073,066 A 1/1963 Edwards et al.
3,097,832 A 7/1963 Murdock et al.
3,145,001 A 8/1964 Bruninga
3,276,096 A 10/1966 McAleer et al.
3,299,785 A 1/1967 James
3,304,680 A 2/1967 Birdwell
3,342,003 A 9/1967 Frank
3,363,371 A 1/1968 Villalobos
3,475,876 A 11/1969 Oroschakoff
3,503,590 A 3/1970 Buysens
3,522,685 A 8/1970 Oroschakoff
3,581,649 A 6/1971 Rauenhorst
3,600,868 A 8/1971 Wilson, Jr. et al.
3,660,215 A 5/1972 Pawlicki
3,672,022 A 6/1972 York
3,757,485 A 9/1973 Vincens
3,769,065 A 10/1973 Dunn
3,789,747 A 2/1974 Wasserman et al.
3,831,333 A 8/1974 Nelsson et al.
3,947,936 A 4/1976 Wheadon
3,991,536 A 11/1976 Rutherford
4,000,241 A 12/1976 Dunn
4,003,178 A 1/1977 Douthwaite
4,011,704 A 3/1977 O'Konski
4,020,612 A 5/1977 Welch
4,056,195 A 11/1977 Keith
4,085,558 A 4/1978 Albrecht
4,099,386 A 7/1978 Sagasta
4,159,302 A 6/1979 Greve et al.
4,179,264 A 12/1979 Vancauwenberghe
4,226,061 A 10/1980 Day, Jr.
4,245,926 A 1/1981 Asszonyi et al.
4,248,022 A 2/1981 Walker
4,255,489 A 3/1981 Nielsen
4,297,866 A 11/1981 Sakauye et al.
4,343,127 A 8/1982 Greve et al.
4,347,155 A 8/1982 Jenkins
4,385,476 A 5/1983 Slager
4,396,685 A 8/1983 Jury
4,447,380 A 5/1984 Shannon et al.
4,464,885 A * 8/1984 Palacio ..... E04C 3/292 52/693
4,485,606 A 12/1984 Gottlieb

(56) References Cited

U.S. PATENT DOCUMENTS 4,510,727 A 4/1985 Jury
4,512,736 A 4/1985 Wader
4,513,551 A 4/1985 Gauffin et al.
4,520,073 A 5/1985 Randolph et al.
4,522,860 A 6/1985 Scott et al.
4,525,388 A 6/1985 Rehder et al.
4,539,787 A 9/1985 Ritter et al.
4,545,170 A 10/1985 Shirey
4,551,957 A 11/1985 Madray
4,558,552 A 12/1985 Reitter, II
4,559,749 A 12/1985 Nusbaum
4,559,752 A 12/1985 Kieffer
4,571,914 A 2/1986 Stoyanoff
4,580,379 A 4/1986 Nusbaum
4,621,397 A 11/1986 Schrenk
4,658,552 A 4/1987 Mulford
4,669,243 A 6/1987 Gore et al.
4,691,493 A 9/1987 Larsen
4,693,048 A 9/1987 Guetersloh
4,695,033 A 9/1987 Imaeda et al.
4,713,921 A 12/1987 Minialoff et al.
4,720,957 A 1/1988 Madray
4,722,861 A 2/1988 Sawaide
4,734,337 A 3/1988 Patton
4,793,113 A 12/1988 Bodnar
4,803,128 A 2/1989 Bender
4,819,395 A 4/1989 Sugita et al.
4,841,705 A 6/1989 Fuhrer
4,843,786 A 7/1989 Walkinshaw et al.
4,893,569 A 1/1990 Hansen
4,897,007 A 1/1990 Chen et al.
4,968,185 A 11/1990 Leibhard et al.
5,002,696 A 3/1991 White
5,027,572 A 7/1991 Purcell et al.
5,029,779 A 7/1991 Bruggeman
5,081,814 A 1/1992 Singletary et al.
5,157,883 A * 10/1992 Meyer ..... E04B 2/766 24/460
5,157,887 A * 10/1992 Watterworth, III ..... E04B 1/944 52/340
5,231,811 A 8/1993 Andrepont et al.
5,249,400 A 10/1993 Turner
5,287,673 A 2/1994 Kreikemeier
5,305,941 A 4/1994 Kent et al.
5,321,928 A 6/1994 Warneke
5,360,771 A 11/1994 Delvaux et al.
5,363,621 A 11/1994 Kroll et al.
5,410,852 A 5/1995 Edgar et al.
5,418,013 A 5/1995 Detrick et al.
5,439,518 A 8/1995 Francis et al.
5,481,843 A 1/1996 Kreikemeier
5,527,590 A 6/1996 Priluck
5,528,876 A 6/1996 Lu
5,529,192 A 6/1996 Conen et al.
5,540,023 A 7/1996 Jaenson
5,570,953 A 11/1996 DeWall
5,590,505 A 1/1997 Bogle
5,592,800 A * 1/1997 Koo ..... E04C 3/292 52/692
5,605,024 A 2/1997 Sucato et al.
5,617,686 A 4/1997 Gallagher, Jr.
5,625,995 A 5/1997 Martin
5,685,116 A 11/1997 Bradshaw et al.
5,697,195 A 12/1997 Maylon
5,716,718 A 2/1998 Lai
5,732,520 A 3/1998 Maietta
5,753,036 A 5/1998 Hornaman et al.
5,755,545 A 5/1998 Banks
5,761,864 A 6/1998 Nonoshita
5,778,626 A 7/1998 Hellsten
5,826,388 A 10/1998 Irving
5,836,135 A 11/1998 Hagan et al.
5,842,276 A 12/1998 Asher et al.
5,845,379 A 12/1998 Steffensen
5,852,908 A 12/1998 Nankin
5,867,949 A 2/1999 Untiedt
5,867,962 A * 2/1999 Scott ..... E04C 3/292 52/696
5,927,035 A 7/1999 Haytayan
5,937,600 A 8/1999 Larson
5,943,775 A 8/1999 Lanahan et al.
5,979,131 A 11/1999 Remmele et al.
5,979,787 A 11/1999 Scarpa
6,035,595 A 3/2000 Anderson
6,047,510 A 4/2000 Gallaway
6,050,048 A 4/2000 Hellsten
6,052,959 A 4/2000 LaBrosse
6,108,991 A 8/2000 Hagan et al.
6,149,701 A 11/2000 Ellingson
6,205,740 B1 3/2001 Ekerholm et al.
6,207,256 B1 3/2001 Tashiro
6,254,981 B1 7/2001 Castle
6,263,629 B1 7/2001 Brown, Jr.
6,305,432 B1 10/2001 Sacks et al.
6,330,777 B1 12/2001 Padley
6,343,452 B1 2/2002 Holden
6,363,679 B1 4/2002 Rutherford
6,390,438 B1 * 5/2002 McManus ..... E04B 5/14 249/19
6,412,249 B1 7/2002 Boyer et al.
6,447,928 B2 9/2002 Suitts
6,460,393 B1 10/2002 Sundhagen
6,481,175 B2 11/2002 Potter et al.
6,584,735 B2 7/2003 Burton
6,609,344 B2 8/2003 Saldana
6,617,386 B2 9/2003 Lelli et al.
6,658,809 B2 12/2003 Collins
6,668,501 B2 12/2003 Adebar et al.
6,754,997 B2 6/2004 Bonin
6,758,743 B1 7/2004 Grosskrueger
6,820,387 B2 11/2004 Sacks et al.
6,823,636 B2 11/2004 Mahoney
6,910,311 B2 6/2005 Lindberg et al.
6,920,734 B2 7/2005 Elderson
6,938,383 B2 9/2005 Morris et al.
6,993,883 B2 2/2006 Belanger
7,117,649 B2 10/2006 Morris et al.
7,143,551 B2 12/2006 Corwin
7,174,688 B2 2/2007 Higginbotham
7,179,165 B2 2/2007 Cook
7,195,556 B1 3/2007 Fichtelman
7,231,746 B2 6/2007 Bodnar
7,287,356 B2 10/2007 Sacks et al.
7,368,175 B2 5/2008 Neth
7,381,261 B1 6/2008 Nelson
7,497,903 B2 3/2009 Wang et al.
7,517,590 B2 4/2009 Wagner
7,538,152 B2 5/2009 Bohler et al.
7,565,775 B2 7/2009 Cooper et al.
7,604,534 B2 10/2009 Hill
7,654,051 B2 2/2010 Pollack
7,690,167 B2 4/2010 Antonic
7,735,294 B2 6/2010 Moody et al.
7,788,868 B2 9/2010 Pollack
7,820,302 B2 10/2010 Krettenauer
7,861,488 B2 1/2011 Giles et al.
7,866,112 B2 1/2011 Edmondson
7,921,537 B2 4/2011 Rodlin
7,955,460 B2 6/2011 Bennett, III et al.
8,074,416 B2 12/2011 Andrews
8,084,117 B2 12/2011 Lalvani
8,171,696 B2 5/2012 Powers, III et al.
8,225,581 B2 7/2012 Strickland et al.
8,234,836 B2 8/2012 Anderson
8,276,321 B2 10/2012 Bell
8,281,551 B2 10/2012 Leek et al.
8,578,576 B2 11/2013 Castricum
8,615,957 B1 * 12/2013 Sacks ..... E04B 5/10 52/647
8,696,781 B2 4/2014 Wallner et al.
8,720,142 B2 5/2014 Spilchen
2003/0029129 A1 2/2003 Walters
2003/0055147 A1 3/2003 Lelli et al.
2003/0126806 A1 7/2003 Ellis

(56) References Cited

U.S. PATENT DOCUMENTS

| | | | | |
|---|---|---|---|---|
| 2004/0000118 | A1* | 1/2004 | Fuerle | E04B 1/943 52/834 |
| 2004/0134158 | A1 | 7/2004 | Farrell, Jr. et al. | |
| 2005/0011156 | A1* | 1/2005 | Tseng | E04C 3/32 52/633 |
| 2005/0055953 | A1 | 3/2005 | Sacks et al. | |
| 2005/0108978 | A1 | 5/2005 | Strickland et al. | |
| 2006/0075715 | A1 | 4/2006 | Serpico et al. | |
| 2006/0265997 | A1 | 11/2006 | Collins, Jr. et al. | |
| 2007/0072541 | A1 | 3/2007 | Daniels, II et al. | |
| 2007/0119106 | A1 | 5/2007 | Sacks et al. | |
| 2007/0175145 | A1 | 8/2007 | Sacks et al. | |
| 2007/0193150 | A1 | 8/2007 | Carlson | |
| 2007/0243820 | A1 | 10/2007 | O'Hagin | |
| 2008/0250738 | A1* | 10/2008 | Howchin | E04B 2/789 52/235 |
| 2009/0013633 | A1 | 1/2009 | Aubuchon | |
| 2009/0186570 | A1 | 7/2009 | Riggins | |
| 2009/0203308 | A1 | 8/2009 | O'Hagin et al. | |
| 2010/0126097 | A1* | 5/2010 | Powers, III | E04C 3/07 52/481.1 |
| 2010/0229501 | A1 | 9/2010 | Bodnar | |
| 2010/0287872 | A1 | 11/2010 | Bodnar | |
| 2010/0300645 | A1 | 12/2010 | Glover | |
| 2011/0021663 | A1 | 1/2011 | Sacks et al. | |
| 2012/0028563 | A1 | 2/2012 | Sacks et al. | |
| 2012/0186190 | A1 | 7/2012 | Powers, III et al. | |
| 2012/0279162 | A1 | 11/2012 | Strickland et al. | |
| 2013/0333172 | A1 | 12/2013 | Wallner et al. | |
| 2015/0240486 | A1 | 8/2015 | Sacks et al. | |
| 2015/0308118 | A1 | 10/2015 | Spilchen et al. | |
| 2015/0345150 | A1 | 12/2015 | Sacks et al. | |

FOREIGN PATENT DOCUMENTS

| | | | |
|---|---|---|---|
| CH | 658 489 | A5 | 11/1986 |
| DE | 40 19 281 | A1 | 12/1991 |
| EP | 0 579 007 | A2 | 1/1994 |
| EP | 0 637 658 | A1 | 2/1995 |
| EP | 0 691 441 | A1 | 1/1996 |
| FR | 2 421 695 | A1 | 11/1979 |
| FR | 2 584 957 | A1 | 1/1987 |
| GB | 311636 | A | 5/1929 |
| GB | 414277 | A | 8/1934 |
| GB | 2 201 184 | A | 8/1988 |
| JP | 4-293848 | A | 10/1992 |
| JP | 7-233611 | A | 9/1995 |
| JP | 11-181989 | A | 7/1999 |
| JP | 2001-65140 | A | 3/2001 |
| JP | 2003-13577 | A | 1/2003 |
| WO | 97/13936 | A1 | 4/1997 |
| WO | 00/53356 | A1 | 9/2000 |
| WO | 2010/059631 | A1 | 5/2010 |
| WO | 2012/024768 | A1 | 3/2012 |

OTHER PUBLICATIONS

Blomberg et al., "Heat Transmission Through Walls With Slotted Steel Studs," *Thermal Envelopes VII/Wall Systems—Principles*, pp. 621-628, 1998. (8 pages).
Demandit, "Interior/Exterior Acrylic Coating in Standard and Custom Colors," Dryvit Systems, Inc., 1990, 1 page.
Höglund et al., "Slotted steel studs to reduce thermal bridges in insulated walls," *Thin-Walled Structures* 32:81-109, 1998.
International Search Report, mailed Feb. 9, 2011, for International Application No. PCT/US2010/050421, 11 pages.
Katz et al., "Handbook of Fillers for Plastics," 1987, pp. 441. (2 pages).
Metallic Demandit, "Interior/Exterior Acrylic Coating with a Metallic Appearance," Dryvit Systems, 1989, 1 page.
National Association of Architectural Metal Manufactures, "Standards for Expanded Metal," NAAMM Standard, EMMA 557-99, 1999, 18 pages.
Quarzite, "Exterior and Interior Quartz Aggregate Finish," Dryvit Systems, 1991, 1 page.
Sacks et al., "Light Weight Aggregate Composition," Office Action, dated Nov. 23, 2010, for U.S. Appl. No. 12/508,384, 8 pages.
Sacks et al., "Lath With Barrier Material," Office Action, dated Aug. 25, 2010, for U.S. Appl. No. 11/679,562, 12 pages.
Sacks et al., "Lath With Barrier Material," Supplemental Amendment, filed Jun. 15, 2010, for U.S. Appl. No. 11/679,562, 5 pages.
Sacks et al., "Lath With Barrier Material," Amendment, filed Apr. 29, 2010, for U.S. Appl. No. 11/679,562, 4 pages.
Sacks et al., "Lath With Barrier Material," Office Action, dated Feb. 3, 2010, for U.S. Appl. No. 11/679,562, 15 pages.
Sacks et al., "Energy Efficient Building Environmental Control Apparatus and Method," Office Action, dated Jul. 8, 2011, for U.S. Appl. No. 12/847,923, 17 pages.
Sacks et al., "Energy Efficient Building Environmental Control Apparatus and Method," Preliminary Amendment, filed Sep. 15, 2010, for U.S. Appl. No. 12/847,923, 11 pages.
Sacks et al., "Twin Track Wire Lath," Notice of Allowance, dated Jul. 26, 2007, for U.S. Appl. No. 10/663,419, 5 pages.
Sacks et al., "Twin Track Wire Lath," Amendment, filed Jun. 18, 2007, for U.S. Appl. No. 10/663,419, 6 pages.
Sacks et al., "Twin Track Wire Lath," Office Action, dated Apr. 10, 2007, for U.S. Appl. No. 10/663,419, 9 pages.
Sacks et al., "Twin Track Wire Lath," Amendment, filed Mar. 9, 2007, for U.S. Appl. No. 10/663,419, 13 pages.
Sacks et al., "Twin Track Wire Lath," Office Action, dated Feb. 9, 2007, for U.S. Appl. No. 10/663,419, 9 pages.
Sacks et al., "Twin Track Wire Lath," Amendment, filed Dec. 4, 2006, for U.S. Appl. No. 10/663,419, 22 pages.
Sacks et al., "Twin Track Wire Lath," Office Action, dated Sep. 5, 2006, for U.S. Appl. No. 10/663,419, 15 pages.
Sacks et al., "Twin Track Wire Lath," Supplemental Amendment, filed Nov. 17, 2005, for U.S. Appl. No. 10/663,419, 19 pages.
Sacks et al., "Twin Track Wire Lath," Amendment, filed Nov. 12, 2005, for U.S. Appl. No. 10/663,419, 12 pages.
Sacks et al., "Twin Track Wire Lath," Office Action, dated Sep. 12, 2005, for U.S. Appl. No. 10/663,419, 10 pages.
Sacks et al., "Twin Track Wire Lath," Office Action, dated Feb. 9, 2005, for U.S. Appl. No. 10/663,419, 10 pages.
Sacks et al., "Twin Track Wire Lath," Amendment, filed Oct. 25, 2004, for U.S. Appl. No. 10/663,419, 14 pages.
Sacks et al., "Twin Track Wire Lath," Office Action, dated Jun. 7, 2004, for U.S. Appl. No. 10/663,419, 12 pages.
Sacks et al., "Light-Weight Metal Stud and Method of Manufacture," Notice of Allowance, dated Aug. 21, 2013, for U.S. Appl. No. 13/767,764, 21 pages.
Sacks et al., "Light-Weight Metal Stud and Method of Manufacture," Amendment, filed Aug. 7, 2013, for U.S. Appl. No. 13/767,764, 17 pages.
Sacks et al., "Light-Weight Metal Stud and Method of Manufacture," Office Action, dated May 14, 2013, for U.S. Appl. No. 13/767,764, 12 pages.
Sacks et al., "Framing Members to Enhance Thermal Characteristics of Walls," Office Action, dated Oct. 9, 2014, for U.S. Appl. No. 14/189,548, 44 pages.
Sacks et al., "Framing Members to Enhance Thermal Characteristics of Walls," U.S. Appl. No. 14/189,548, filed Feb. 25, 2014, 68 pages.
Sacks et al., "One Coat Stucco Lath and Method of Manufacture," Amendment, filed Sep. 18, 2015, for U.S. Appl. No. 14/292,542, 24 pages.
Sacks et al., "One Coat Stucco Lath and Method of Manufacture," Amendment, filed Mar. 6, 2015, for U.S. Appl. No. 14/292,542, 77 pages.
Sacks et al., "One Coat Stucco Lath and Method of Manufacture," Office Action, dated Sep. 8, 2014, for U.S. Appl. No. 14/292,542, 20 pages.
Sacks et al., "One Coat Stucco Lath and Method of Manufacture," Office Action, dated Mar. 18, 2015, for U.S. Appl. No. 14/292,542, 21 pages.

(56) References Cited

OTHER PUBLICATIONS

Sacks et al., "One Coat Stucco Lath and Method of Manufacture," Office Action, dated Oct. 2, 2015, for U.S. Appl. No. 14/292,542, 14 pages.
Sacks et al., "One Coat Stucco Lath and Method of Manufacture," Amendment, dated Mar. 24, 2016, for U.S. Appl. No. 14/292,542, 27 pages.
Sacks et al., "Framing Members to Enhance Thermal Characteristics of Walls," Office Action, dated Feb. 4, 2016, for U.S. Appl. No. 14/681,919, 21 pages.
Sacks et al., "Framing Members to Enhance Thermal Characteristics of Walls," Amendment, filed Nov. 4, 2015, for U.S. Appl. No. 14/681,919, 21 pages.
Sacks et al., "Framing Members to Enhance Thermal Characteristics of Walls," Office Action, dated Aug. 4, 2015, for U.S. Appl. No. 14/681,919, 26 pages.
Spilchen et al., "Reinforcing Insert Article, Kit and Method," U.S. Appl. No. 61/903,513, filed Nov. 13, 2013, 39 pages.
Spilchen et al., "Reinforcing Insert Article, Kit and Method," Amendment, filed Dec. 18, 2015, for U.S. Appl. No. 14/795,731, 21 pages.
Spilchen et al., "Reinforcing Insert Article, Kit and Method," Office Action, dated Sep. 18, 2015, for U.S. Appl. No. 14/795,731, 25 pages.
Spilchen et al., "Reinforcing Insert Article, Kit and Method," Office Action, dated Mar. 18, 2016, for U.S. Appl. No. 14/795,731, 17 pages.
Spilchen et al., "Stabilized Lath and Method of Manufacture," Notice of Allowance, dated Feb. 11, 2014, for U.S. Appl. No. 13/592,784, 7 pages.
Spilchen et al., "Stabilized Lath and Method of Manufacture," Amendment, filed Jan. 14, 2014, for U.S. Appl. No. 13/592,784, 33 pages.
Spilchen et al., "Stabilized Lath and Method of Manufacture," Office Action, dated Aug. 26, 2013, for U.S. Appl. No. 13/592,784, 11 pages.
Wallner Tooling\Expac, Inc., "Decorative/Standard Patterns," retrieved on May 6, 2014, from http://www.expac.com/decorative_patterns.htm, 2 pages.
Wallner Tooling\Expac, Inc., "Expanded Metal & Pleasted Filters for HVAC Industry," retrieved on May 6, 2014, from http://www.expac.com/hvac.htm, 1 page.
Wallner Tooling\Expac, Inc., "Glossary of Expanded Metal," retrieved on May 6, 2014, from http://www.expac.com/glossary.htm, 2 pages.
Wallner Tooling\Expac, Inc., "Standard Patterns," retrieved on May 6, 2014, from http://www.expac.com/standardportfolio.htm, 2 pages.
Wallner et al., "Expanded Metal and Process of Making the Same," U.S. Appl. No. 13/970,472, filed Aug. 19, 2013, 27 pages.
Wallner et al., "Expanded Metal and Process of Making the Same," Preliminary Amendment, filed Oct. 16, 2013, for U.S. Appl. No. 13/970,472, 12 pages.
Sacks et al., "One Coat Stucco Lath and Method of Manufacture," Office Action, dated Apr. 26, 2016, for U.S. Appl. No. 14/292,542, 28 pages.
International Search Report, Mailed Sep. 30, 2016, for International Application No. PCT/CA2016/050900, 3pages.

* cited by examiner

LIGHT-WEIGHT METAL STUD AND METHOD OF MANUFACTURE

BACKGROUND

Technical Field

The present disclosure relates to structural members, and more particularly, to metal studs.

Description of the Related Art

Metal studs and framing members have been used in the areas of commercial and residential construction for many years. Metal studs offer a number of advantages over traditional building materials, such as wood. For instance, metal studs can be manufactured to have strict dimensional tolerances, which increase consistency and accuracy during construction of a structure. Moreover, metal studs provide dramatically improved design flexibility due to the variety of available sizes and thicknesses and variations of metal materials that can be used. Moreover, metal studs have inherent strength-to-weight ratio which allows them to span longer distances and better resist forces such as bending moments.

Although metal studs exhibit these and numerous other qualities, there are some challenges associated with their manufacture and use in construction. For instance, existing designs typically sacrifice strength over weight of the stud. Conventional metal studs are often formed from one piece of metal and weigh about 0.77 pounds per foot, or 6.2 pounds per eight foot stud having dimensions of 3⅝ inch deep by 1¼ inch flange of 22 gauge.

Furthermore, manufacturing efficiency considerations can play a large role in the design of a metal stud because additional manufacturing operations can quickly increase the cost of each stud, which results in an unmarketable metal stud. Thus, the uniform design of existing metal studs often employ more material than is necessary for a given strength.

BRIEF SUMMARY

A light-weight metal stud may include a first elongated channel member having a respective major face having a respective first edge along a major length thereof. The first elongated channel member may include a respective second edge along the major length thereof and a respective first flange extending along the first edge at a non-zero angle to the respective major face of the first elongated channel member. The first elongated channel member may include a respective second flange extending along the second edge at a non-zero angle to the respective major face of the first elongated channel member.

The stud may include a second elongated channel member having a respective major face having a respective first edge along a major length thereof. The second elongated channel member may include a respective second edge along the major length thereof and a respective first flange extending along the first edge at a non-zero angle to the respective major face of the second elongated channel member. The second elongated channel member may include a respective second flange extending along the second edge at a non-zero angle to the respective major face of the second elongated channel member.

The stud may include a first continuous wire member (or metal coupler member) having a plurality of bends to form alternating apexes along a respective length thereof. The apexes of the first continuous wire member may be alternatively physically attached to the first and the second elongated channel members along at least a portion of the first and the second elongated channel members. The stud may include a second continuous wire member (metal coupler member) having a plurality of bends to form alternating apexes along a respective length thereof. The apexes of the second continuous wire member may be alternatively physically attached to the first and the second elongated channel members along at least a portion of the first and the second elongated channel members. The first and the second elongated channel members may be held in spaced apart parallel relation to one another by both of the first and the second wire members. A longitudinal passage may be formed between the first and the second wire members.

In some aspects, the first and the second wire members are physically attached to one another at each point at which the first and the second wire members cross one another. This may form a wire matrix having a plurality of intersection points. Each of the apexes of the second wire member is opposed to a respective one of the apexes of the first wire member across the longitudinal passage. In some aspects, the respective second flange of at least one of the first or the second elongated channel member is a non-right angle. In some aspects, the respective second flange of at least one of the first or the second elongated channel member is a rolled edge. In some aspects, the respective second flange of each of the first and the second elongated channel member is has an arcuate profile.

The first flange of at least one of the first or the second elongated channel member may be corrugated, which may include a number of ridges or valleys extending along the major length of the first edge. The first and the second continuous wires may be physically attached to the ridges or the valleys of the respective first flange of at least one of the first and the second elongated channel member via welds. In some aspects, the first and the second continuous wires do not physically contact the respective major faces of at least one of the first or the second elongated channel member.

In some aspects, a first longitudinal wire member extends along the major length of the first channel member and is spaced inwardly from the first channel member toward the second channel member. A second longitudinal wire member may also extend along the major length of the second channel member and spaced inwardly from the second channel member toward the first channel member, and spaced apart from the first longitudinal wire member.

Because of the configurations discussed in the present disclosure, the stud has improved compression and tension resistance as compared to existing studs. Moreover, the distance (pitch) between each apex along the stud is dramatically decreased due to the angle of the bends of the wires and the configuration of providing two wires alternately extending between the channel members. This provides further strength without increasing the weight of the stud. Another advantage of the present disclosure is an increase in stiffness due to the position and attachment of the plurality of apexes to the flanges of the channel members. This is particularly advantageous when applying a force to the first and second channel members, such as when drilling a fastener through the members for attachment to a wall or attachment of a utility device or line. The increased stiffness may provide resistance characteristics such that the stud will not buckle or flex under a given load or force, for example.

Furthermore, securing the apexes to the flanges of the channel members (as opposed to the major faces) provides one advantage to reduce manufacturing operations and improve consistency of the size and shape of the stud because the channel members can be positioned relative to each other, as opposed to relative to the shape and size of the wire matrix defined by the apexes, which may vary between manufacturing operations of each stud. Spatially positioning the wire matrix away from the major faces further provides improved strength without increasing weight of the stud because a transfer of forces between the channel members is reduced because the wire matrix is coupled to the flanges, not directly to the major faces. Accordingly, a stiffer and lighter metal stud is provided while minimizing manufacturing operations and material use per stud, as compared to existing metal studs.

Because of the configuration of some or all of the various aspects discussed in the present disclosure, the metal stud is stronger and lighter than conventional metal studs. In its basic form, the metal stud of the present disclosure with similar dimensions and strength as the 3⅝ inch stud discussed in the background section can weigh about 0.58 pounds per foot, or 4.67 pounds per eight foot stud, although this weight may vary depending on the cross sectional size of the stud. Thus, the metal stud is at least 25 percent lighter than conventional metal studs, and stronger for the reasons discussed in the present disclosure. This has one advantage of reduced manufacturing and shipping costs, and another advantage of reduced overall weight of a structure that may have a plurality of metal studs forming walls and trusses.

A method of making a metal stud may include providing a first elongated channel member having a respective major face having a respective first edge along a major length thereof. The first elongated channel member may be formed to have a respective second edge along the major length thereof and a respective first flange extending along the first edge at a non-zero angle to the respective major face of the first elongated channel member. The first elongated channel member may be formed to have a respective second flange extending along the second edge at a non-zero angle to the respective major face of the first elongated channel member.

The method may include providing a second elongated channel member having a respective major face having a respective first edge along a major length thereof and a respective second edge along the major length thereof. The second elongated channel member may be formed to have a respective first flange extending along the first edge at a non-zero angle to the respective major face of the second elongated channel member, and a respective second flange extending along the second edge at a non-zero angle to the respective major face of the second elongated channel member.

The method may include coupling the first and the second elongated channel member together with a first and a second continuous wire member. The first and second continuous wire members may be formed with a plurality of bends to form alternating apexes along a respective length thereof. The apexes of the first continuous wire member may be alternatively physically attached to the first and the second elongated channel members along at least a portion of the first and the second elongated channel members. The apexes of the second continuous wire member may be alternatively physically attached to the first and the second elongated channel members along at least a portion of the first and the second elongated channel members.

The method may include physically attaching the first and the second continuous wire members to one another at intersection points, which may occur before the coupling the first and the second elongated channel member together via the first and the second continuous wire members. The method may include rolling the respective second edge of the first and the second channel members to form the non-right angle flange.

BRIEF DESCRIPTION OF THE SEVERAL VIEWS OF THE DRAWINGS

In the drawings, identical reference numbers identify similar elements. For clarity of illustration, similar elements within a figure may only be called out for a representative element of similar elements. Of course, any number of similar elements may be included in a metal stud, and the number of similar elements shown in a drawing is intended to be illustrative, not limiting. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION

Figure 1A:
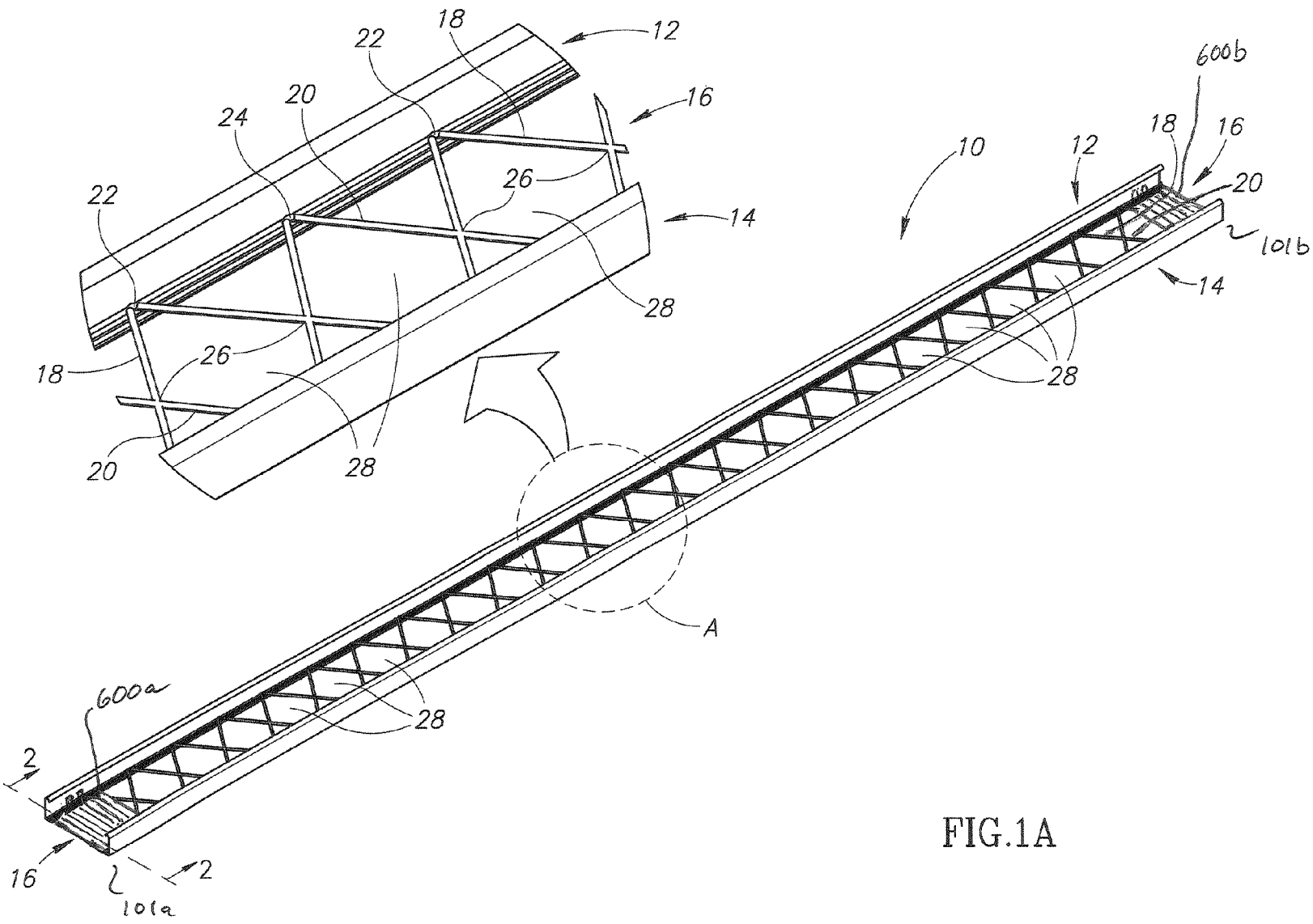
FIG. 1A is an isometric view, with an enlarged partial view, of a metal stud according to one aspect of the disclosure.

FIG. 1A shows a light-weight metal stud 10 according to one aspect of the present disclosure. The stud 10 includes a first elongated channel member 12 and a second elongated channel member 14 positioned at least approximately parallel to and spatially separated from each other. A wire matrix 16 is coupled to and positioned between the first elongated channel member 12 and a second elongated channel member 14 at various portions along the lengths of the members.

Figure 1B:
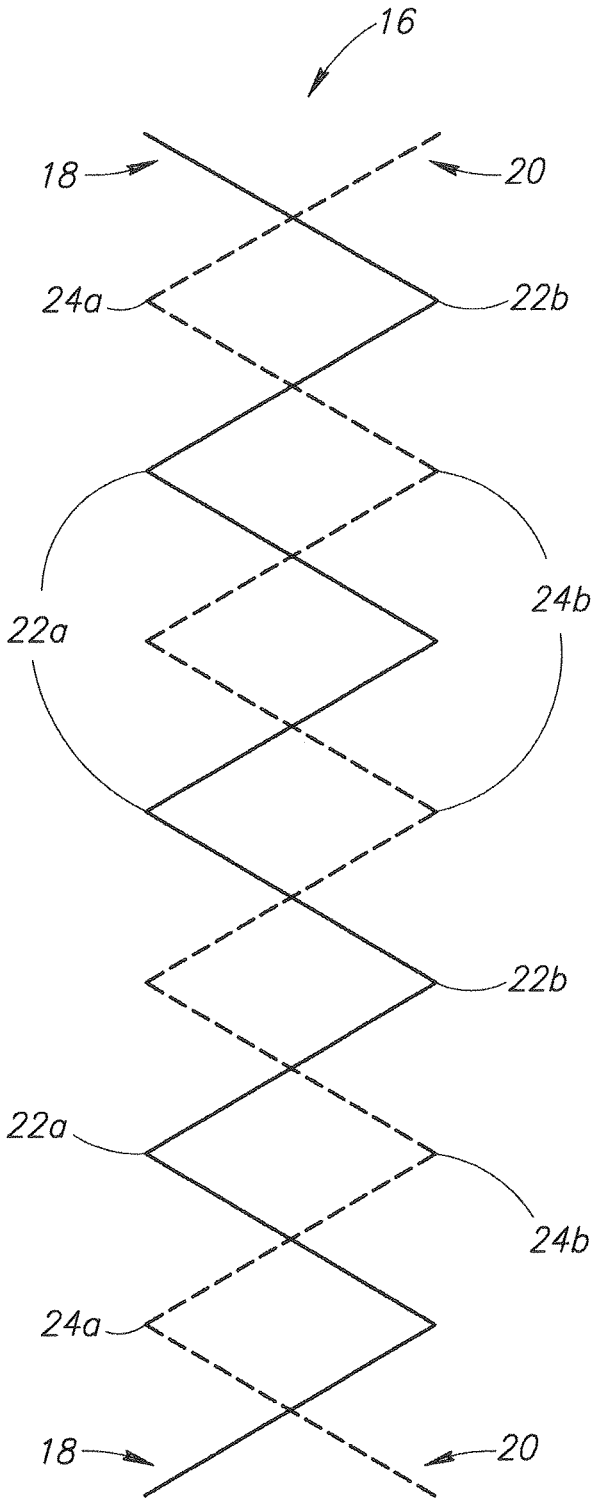
FIG. 1B is schematic view of a wire matrix of the metal stud of FIG. 1A.
Figure 2:
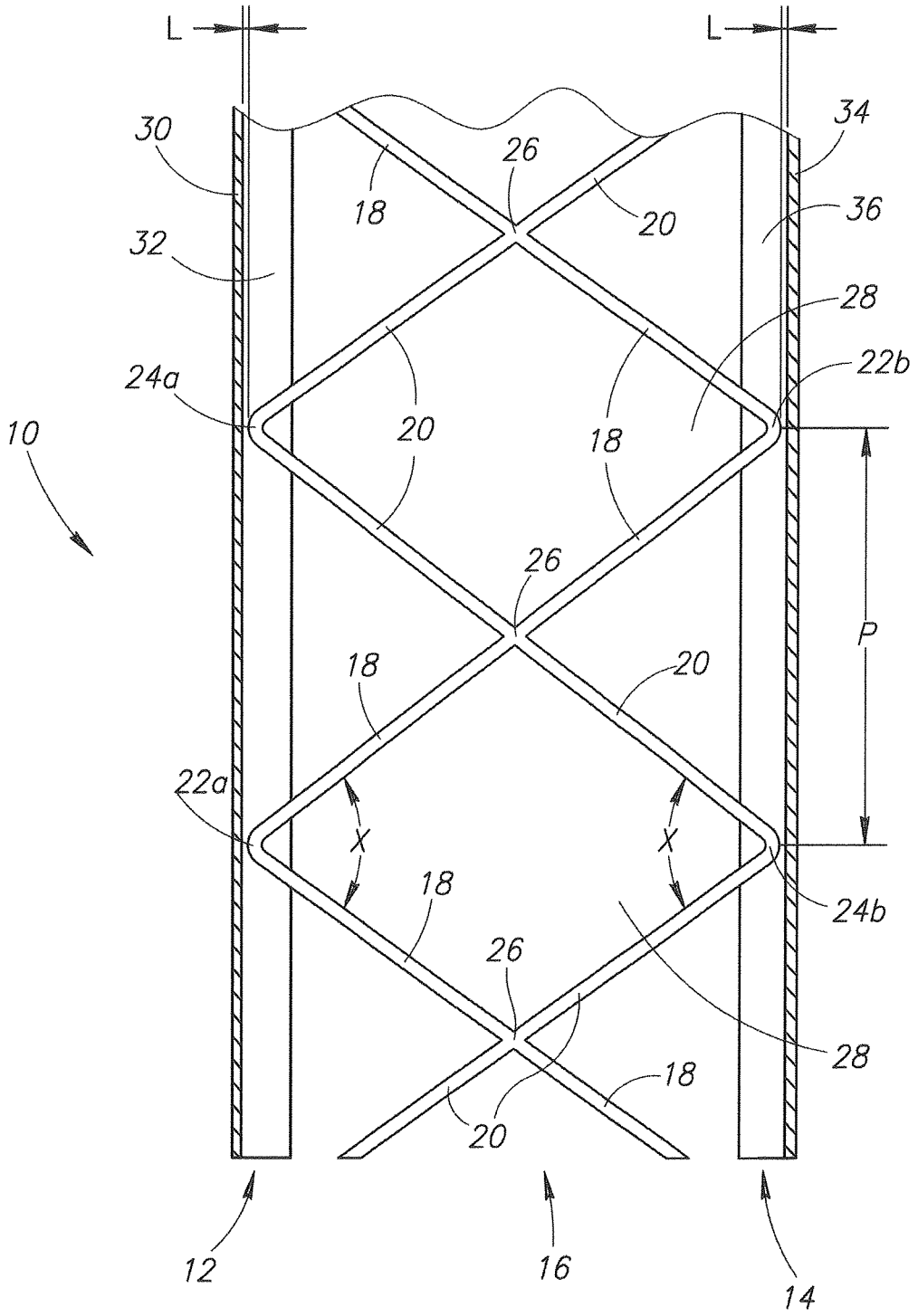
FIG. 2 is a cross-sectional view of a portion of a metal stud according to one aspect of the disclosure.

As illustrated in cutout A, the wire matrix 16 may be comprised of a first angled continuous wire 18 and a second angled continuous wire 20 coupled to each other (FIG. 1B). The first and second angled continuous wires 18, 20 may each be a continuous piece of metal wire. The first angled continuous wire 18 include a plurality of bends that form a plurality of first apexes 22 that successively and alternately contact the first elongated channel member 12 and the second elongated channel member 14. Likewise, the second angled continuous wire 20 may include a plurality of bends that form a plurality of second apexes 24 to successively and alternately contact the first elongated channel member 12 and the second elongated channel member 14 (FIG. 2). The wire matrix 16 may be formed by overlying the first angled continuous wire 18 onto the second angled continuous wire 20 and securing the wires to each other, for example with a series of welds, thereby forming a series of intersection points 26 positioned between the first and second elongated channel members 12, 14. The wire matrix 16 may be secured to the first and second elongated channel members 12, 14 at all first and second apexes 22, 24 such that the first apexes 22 alternate with the second apexes 24 along at least a portion of a length of the first elongated channel member 12 and along at least a portion of a length of the second elongated channel member 14. Accordingly, a series of longitudinal passages 28 are formed along a central length of the wire matrix 16. The longitudinal passages 28 may be quadrilaterals, for instance diamond-shaped longitudinal passages. The longitudinal passages 28 may be sized to receive utilities, for example wiring, wire cables, fiber optic cable, tubing, pipes, other conduit.

The first and second angled continuous wires 18, 20 may each have any of a variety of cross-sectional profiles. Typically, first and second angled continuous wires 18, 20 may each have a round cross-sectional profile. Such may reduce materials and/or manufacturing costs, and may advantageously eliminate sharp edges which might otherwise damage utilities (e.g., electrically insulative sheaths). Alternatively, the first and second angled continuous wires 18, 20 may each have cross-sectional profiles of other shapes, for instance a polygonal (e.g., rectangular, square, hexagonal). Where a polygonal cross-sectional profile is employed, it may be preferred to have rounded edges or corners between at least some of the polygonal segments. Again, this may eliminate sharp edges which might otherwise damage utilities (e.g., electrically insulative sheaths). Further, the second angled continuous wire 20 may a different cross-sectional profile from that of the first angled continuous wire 18.

FIG. 1B shows the particular configuration of a wire matrix 16 of the stud 10 shown in FIG. 1A according to one aspect. The wire matrix 16 includes a first angled continuous wire 18 overlying a second angled continuous wire 20, which is shown in dashed lines for purposes of illustration. This illustration better shows that each of the first and second angled continuous wires 18, 20 extend between both of the first and second elongated channel members 12, 14 in an overlapping manner such that a length of each first and second angled continuous wires 18, 20 extends from one elongated channel member to the other elongated channel member in an alternating manner (FIG. 2). Accordingly, the first angled continuous wire 18 includes a plurality of apexes 22*a* and 22*b* on either side of the first angled continuous wire 18, and the second angled continuous wire 20 includes a plurality of apexes 24*a* and 24*b* on either side of the second angled continuous wire 20 for attachment to both of the first and second elongated channel members 12, 14.

Figure 5:
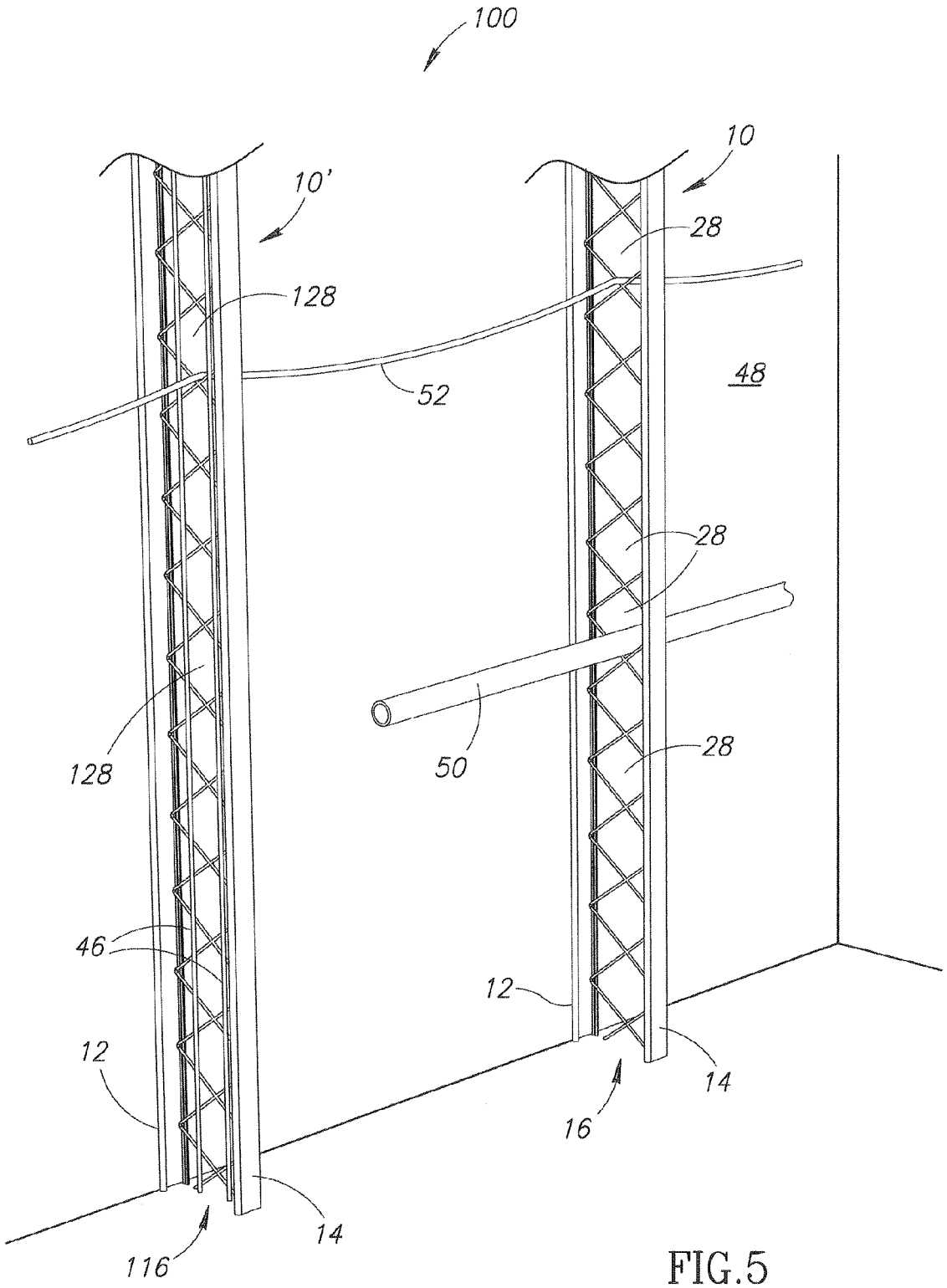
FIG. 5 is an isometric environmental view showing two metal studs adjacent a wall according to some aspects of the disclosure.
Figure 9:
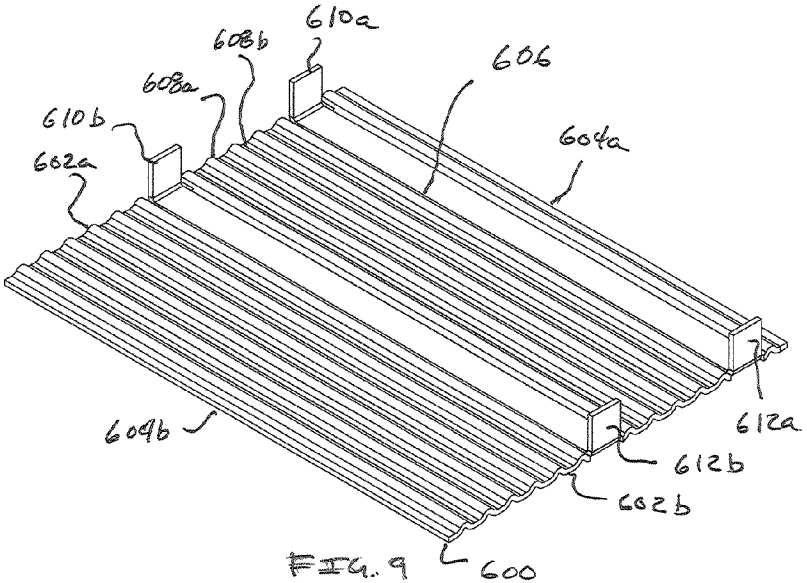
FIG. 9 is an isometric view of the reinforcement plate of FIG. 6 in the folded configuration.
Figure 8:
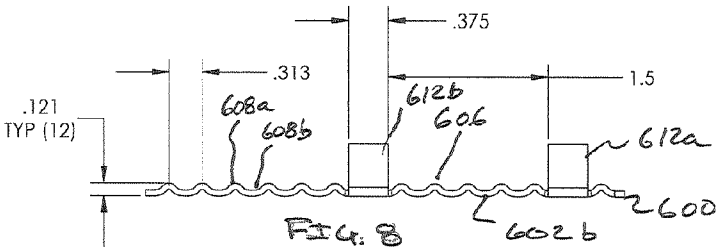
FIG. 8 is a right side elevational view of the reinforcement plate of FIG. 6 in the folded configuration.
Figure 6:
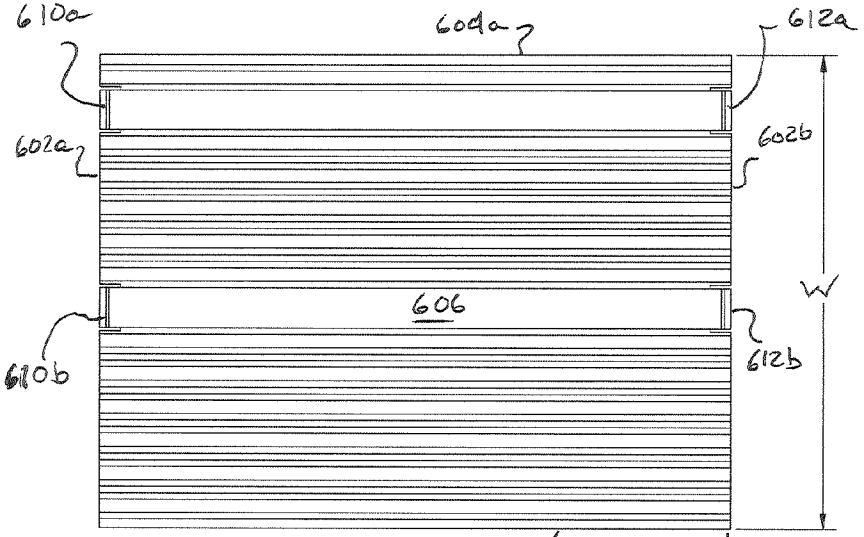
FIG. 6 is a top plan view of an reinforcement plate in a folded configuration, according to at least one illustrated embodiment.
Figure 7:
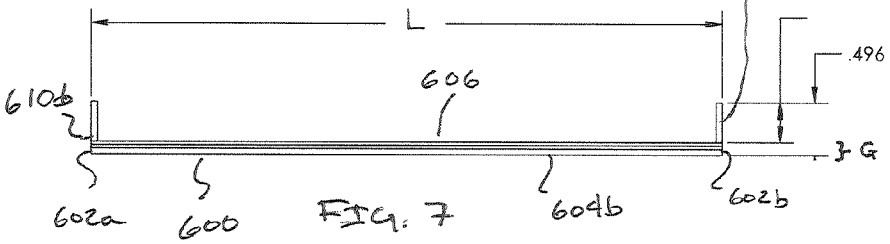
FIG. 7 is a front elevational view of the reinforcement plate of FIG. 6 in the folded configuration.

FIG. 2 shows a portion of a front cross-sectional view of a stud 10 taken along lines 2-2 of FIG. 1A. The first elongated channel member 12 and the second elongated channel member 14 are shown positioned parallel to and spatially separated from each other with the wire matrix 16 coupling the elongated channel members 12, 14 to each other. The first angled continuous wire 18 is formed with a plurality of bends that form a plurality of first apexes 22*a*, 22*b* that successively and alternately contact the first elongated channel member 12 and the second elongated channel member 14. Likewise, the second angled continuous wire 20 is formed with a plurality of bends that form a plurality of second apexes 24*a*, 24*b* to successively and alternately contact the first elongated channel member 12 and the second elongated channel member 14. The wire matrix 16 may be formed by overlying the first angled continuous wire 18 onto the second angled continuous wire 20 securing the wires to each other with a series of welds, thereby forming a series of intersection points 26 positioned between the first and second elongated channel members 12, 14. The wire matrix 16 may be secured to the first and second elongated channel members 12, 14 at all first and second apexes 22, 24 such that the first apexes 22*a* alternate with the second apexes 24*a* along a length the first elongated channel member 12, and the first apexes 22*b* alternate with the second apexes 24*b* along a length second elongated channel member 14. Accordingly, a series of longitudinal passages 28 are formed along a longitudinal length of the wire matrix 16. The longitudinal passages 28 have a profile that is substantially separate from the first and second elongated channel members 12, 14. As such, the longitudinal passages 28 may act as a shelf to support and receive utility lines or other devices (FIG. 5).

Where the stud 10 is installed vertically, the first and second angled continuous wires 18, 20 will run at angles to the ground and gravitational vector (i.e., force of gravity), that is be neither horizontal nor vertical. Thus, the portions of the first and second angled continuous wires 18, 20 which form each longitudinal passages 28 are sloped with respect to the ground. Utilities installed or passing through a longitudinal passage 28 will tend, under the force of gravity, to settle into a lowest point or valley in the longitudinal passage 28. This causes the utility to be at least approximately centered in the stud 10, referred to herein as self-centering. Self-centering advantageously moves the utility away from the portions of the stud to which wallboard or other materials will be fastened. Thus, self-centering helps protect the utilities from damage, for instance damage which might otherwise be caused by the use of fasteners (e.g., screws) used to fasten wallboard or other materials to the stud 10.

Figure 3:
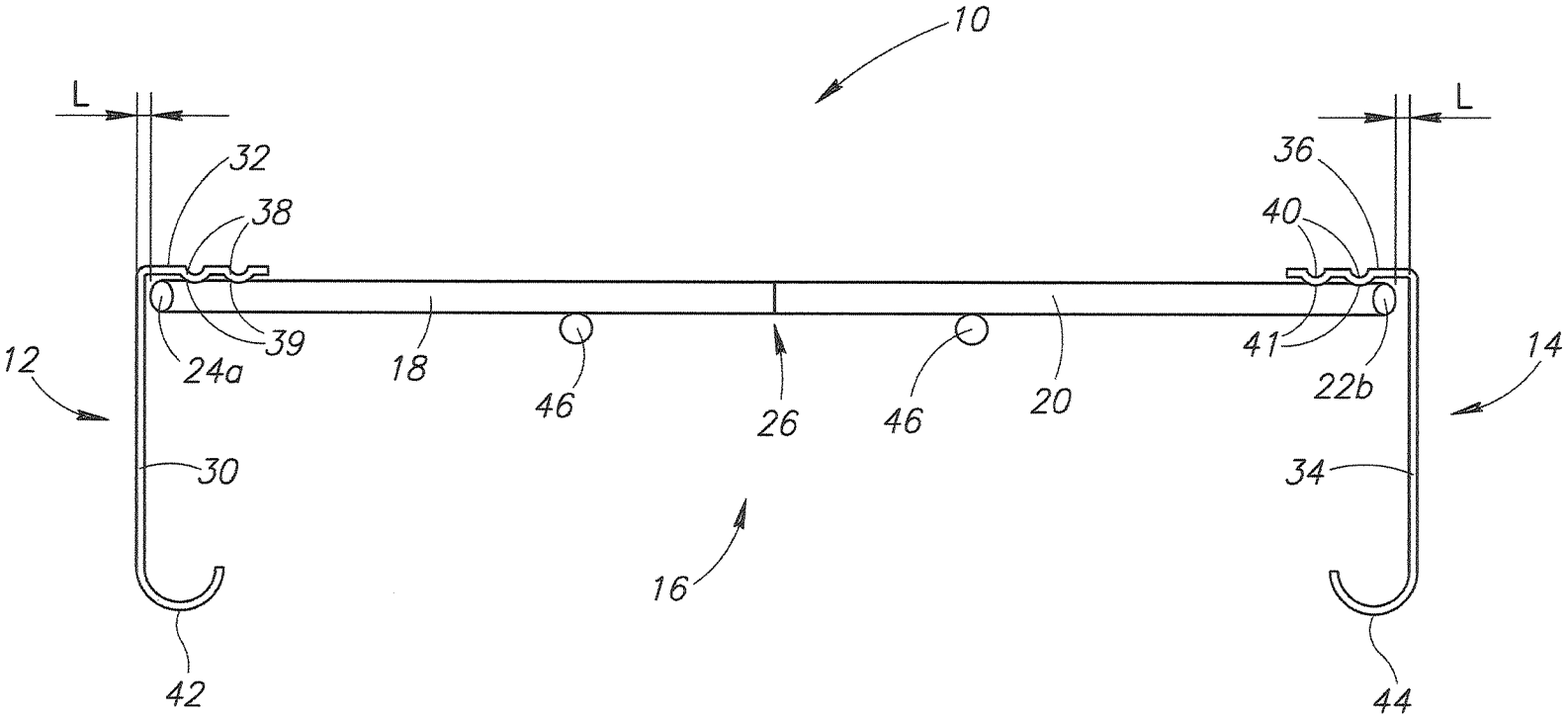
FIG. 3 is a top plan view of a metal stud according to one aspect of the disclosure.

The first elongated channel member 12 may have a major face 30 and a first flange 32. Likewise, the second elongated channel member 14 may have a major face 34 and a first flange 36 (FIG. 3). The wire matrix 16 may be coupled to the flanges 32, 36 periodically along a length of the first and second elongated channel members 12, 14. In some aspects, the first apexes 22*a*, 24*a* may be coupled to the first flange 32 of the first elongated channel member 12 and spatially separated from the major face 30 by a distance L. Likewise, the second apexes 24*b*, 24*b* may be coupled to the first flange 36 of the second elongated channel member 14 and spatially separated from the major face 34 by a distance L. The distance L in any aspect of the present disclosure can vary from a very small to a relatively large distance. In a preferred configuration, distance L is less than one half of an inch, and more preferably less than one quarter of an inch, although distance L can vary beyond such distances. Spatially positioning the apexes from the major faces of the elongated channel members provides one advantage of reducing manufacturing operations and improving consistency of the size and shape of the stud because the elongated channel members can be positioned and secured to the wire matrix relative to each other, as opposed to relative to the shape and size of the wire matrix, which may vary between applications.

According to some aspects, the first apexes 22 and the second apexes 24 laterally correspond to each other as coupled to respective first and second elongated channel members 12, 14. For example, the first apexes 22*a* may be opposed, for instance diametrically opposed, across a longitudinal axis from the second apexes 24*a* along a length the first elongated channel members 12, 14. For example, apex 22*a* is positioned at a contact portion of the first elongated channel member 12 that corresponds laterally to the position of the apex 24*b* on the second elongated channel member 14. The same holds true for apex 24*a* and apex 22*b*, as best illustrated in FIG. 2. The plurality of first and second apexes 22, 24 extend along the length of the stud 10 and are coupled successively and alternately to the first and second elongated channel members 12, 14. Such configuration provides a light-weight metal stud that has improved stiffness characteristics and increased tensile and compression strength, while reducing weight compared to other metal studs. Added stiffening may be provided for fasteners (e.g., screws) for fastening sheathing, drywall or wallboard, and prevents the flange face from rotating away.

Another advantage of the configuration of the stud of the present disclosure is the reduction in distance between apexes along a longitudinal distance of each of the channel members because the wire matrix is formed with two overlapping wires that each fully extend between the elongated channel members. For example, the first angled continuous wire 18 has an apex 22*b* coupled to the second elongated channel member 14, while the second angled continuous wire 20 has an apex 24*b* coupled to the second elongated channel member 14 adjacent apex 22*b* at a pitch P. Pitch P is a given distance that is much shorter than is provided with existing studs. In a preferred configuration, Pitch P is a given distance less than ten inches, and more preferably less than eight inches, although the given distance can vary beyond such distances. Providing a given distance of pitch P provides increased strength of the stud 10 without substantially or noticeably increasing the weight of the stud 10. Another advantage of providing a pitch having a shorter given distance is an increase in stiffness of the stud 10. This is particularly advantageous when applying a force to the major faces 30, 34, such as drilling a fastener through the major faces 30, 34 during and after installation of the stud. The increased stiffness will tend to provide a sufficient biasing force against a drilling force such that the major faces 30, 34 and the stud 10 will not buckle or flex, for example.

Another advantage of the configuration of the stud of the present disclosure is that the first and second angled continuous wires 18, 20 are formed to increase stiffness of the stud 10 and reduce bending moments of the stud 10 under a force. For example, the first and second angled continuous wires 18, 20 may be bent at an angle X, as shown near the apex 22*a* and apex 24*b*. Angle X is preferably between approximately 30 and 60 degrees, and more preferably approximately 45 degrees, although angle X could vary beyond such values and range. Angle X has a corresponding relationship to pitch P. Thus, the continuous wires could be formed at a relatively small angle X (less than 30 degrees), which reduces the distance of pitch P, which can increase strength of the stud for particular applications.

FIG. 3 shows a top view of a light-weight metal stud 10 according to one aspect of the disclosure. The stud 10 includes a first elongated channel member 12 and a second elongated channel member 14 positioned parallel to and spatially separated from each other. A wire matrix 16 is coupled to the first elongated channel member 12 and the second elongated channel member 14 and is positioned substantially perpendicular relative to major faces 30, 34 of the first and second elongated channel members 12, 14. The wire matrix 16 includes a first angled continuous wire 18 and a second angled continuous wire 20 coupled to each other at intersection points 26. As discussed with reference to FIGS. 1A and 2, the first and second angled continuous wires 18, 20 are coupled to the first and second elongated channel members 12, 14 at a plurality of apexes, as exemplified by apex 22*b* and apex 24*a* on FIG. 3.

The first elongated channel member 12 may have a major face 30 and a first flange 32. The first flange 32 may be formed at approximately a 90 degree angle (or non-zero angle) relative to the major face 30. The first flange 32 may include a pair of corrugated portions 38 extending longitudinally along a length of the first flange 32. The ribbed or corrugated portions 38 may have contact portions 39 coupled successively to the wire matrix 16. Likewise, the second elongated channel member 14 may have a major face 34 and a first flange 36. The first flange 36 may be formed at approximately a 90 degree angle (or non-zero angle) relative to the major face 34. The first flange 36 may include a pair of corrugated portions 40 extending longitudinally along a length of the first flange 36. The corrugated portions 40 may have contact portions 41 coupled successively to the apexes 22, 24 of the wire matrix 16. As discussed elsewhere in the disclosure, the first and second angled continuous wires 18, 20 of the wire matrix 16 may be coupled to the flanges 32, 36 periodically along a length of the first and second elongated channel members 12, 14. Such attachment between the wire matrix 16 and the first and second elongated channel members 12, 14 may occur along the corrugated portions 38, 40, which may be achieved by spot welding, resistance welding, or other suitable attachment means at the contact portions 39, 41 of the elongated channel members.

It is preferable that the corrugated portions 38, 40 are each formed as a ridges or valleys, but the corrugated portions 38, 40 may be formed into other shapes. Providing at least one corrugated portion on each flange of each elongated channel member welded to the wire matrix further strengthens the stud by preventing or reducing undesirable flexing or bending due to external forces during and after installation of the stud. Furthermore, the corrugated portions provide high-points of contact between the wire matrix and the elongated channel members, which reduces overall contact area of the components of the stud. This dramatically improves weldability of the wire matrix and the elongated channel members. This also increases weld strengths with much lower energy requirements, less distortion of the stud caused by heat, and reduced burn marks and loss of galvanic zinc coating on the stud. Such advantages also reduce the manufacturing time and operations to form a stud while reducing the weight of the stud.

According to some aspects, the first and second elongated channel members 12, 14 include a respective second flange 42, 44. The second flange 42 extends from the major face 30 of the first elongated channel member 12 inwardly and in an arc-shaped configuration, which may be achieved by rolling the second flange 42 inwardly. Likewise, the second flange 44 extends from the major face 34 of the second elongated channel member 14 inwardly and in an arc-shaped configuration, which may be achieved by rolling the second flange 42 inwardly. Thus, the first and second elongated channel members 12, 14 may each have a J-shaped cross sectional profile. In some aspects, the rolled second flanges 42, 44 can be formed to 45 degrees to almost 360 degrees relative to respective major faces 30, 34. The arc-shaped configuration provides one advantage over existing angled configurations by increasing the strength of the stud 10 while reducing weight because an arc-shaped member tends to counteract bending moments better than angular configuration, particularly when the arc-shaped second flanges 42, 44 are positioned farther away from the bending moments experienced near the first flanges 32, 36 of the wire matrix 16. Furthermore, forming an arc-shaped support member includes fewer operations than forming a multi-angled flange, as with existing studs, which reduces the complexity and manufacturing processes of the stud 10.

According to some aspects, the wire matrix 16 may be coupled to the first flange 32 of the first elongated channel member 12 and spatially separated from the major face 30 by a distance L such that the all apexes are not in contact with the major face 30. Likewise, the wire matrix 16 may be coupled to the first flange 36 of the second elongated channel member 14 and spatially separated from the major face 34 by a distance L, as further discussed with reference to FIG. 2.

According to some aspects, a pair of longitudinal wires 46 may be coupled to the first and second wire members 18, 20. The wire members 18, 20 may extend along the major length of the first channel member and may be spaced inwardly from the first channel member 12 toward the second channel member 14 (FIG. 5). The longitudinal wires 46 may be secured for additional structural support and for positioning utility lines that may traverse through the various longitudinal passages defined by the wire matrix 16 and the pair of longitudinal wires 46.

Figure 4:
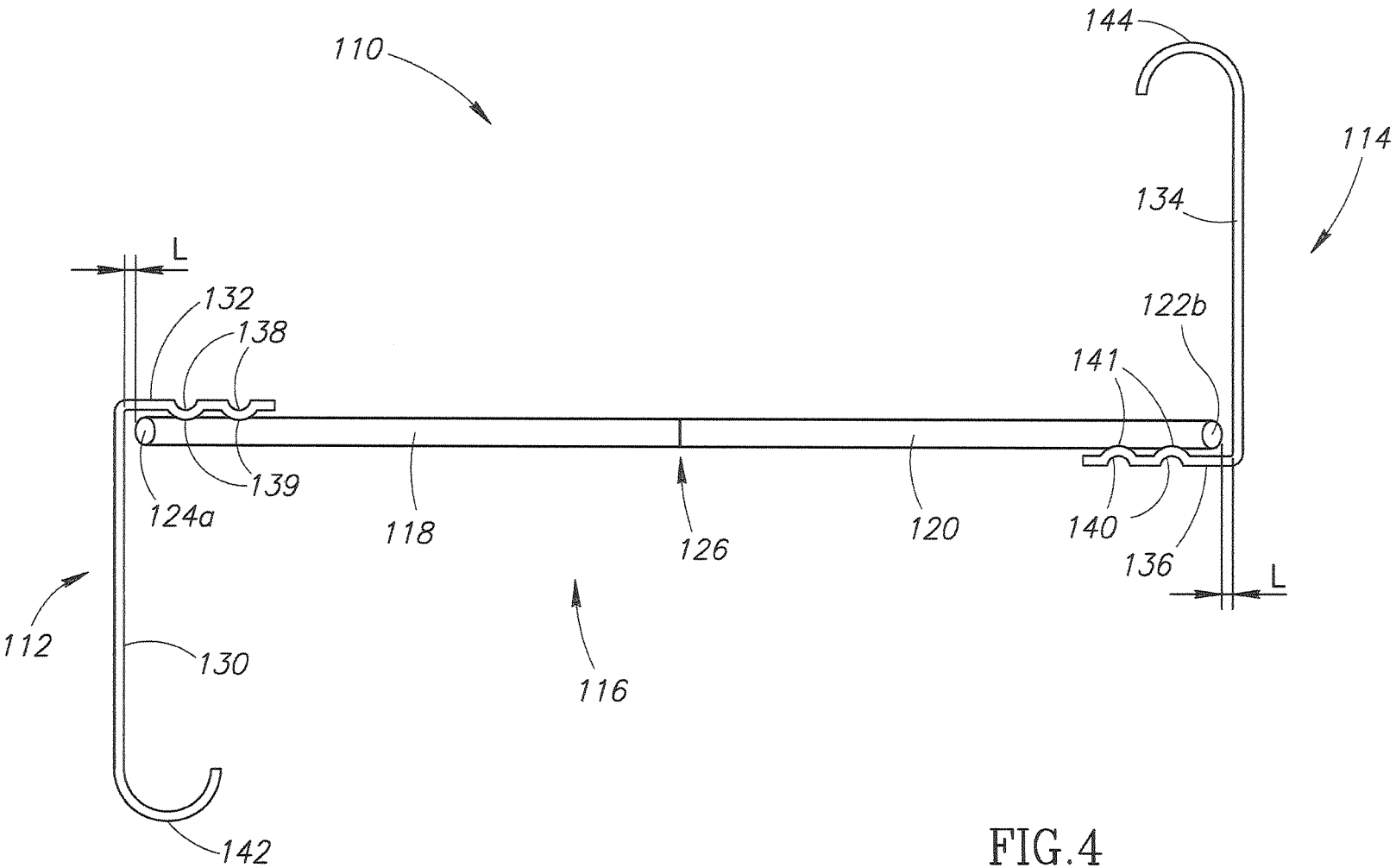
FIG. 4 is a top plan view of a metal stud according to one aspect of the disclosure.

FIG. 4 shows a top view of a light-weight metal stud 110 according to one aspect of the disclosure. The stud 110 includes a first elongated channel member 112 and a second elongated channel member 114 positioned parallel to and spatially separated from each other. In this regard, the second elongated channel member 114 is "flipped" or inverted relative to the first elongated channel member 112, as compared to the description regarding FIGS. 1A-3. Accordingly, a wire matrix 116 is coupled to the first elongated channel member 112 and a second elongated channel member 114 and is positioned approximately perpendicular relative to the first and second elongated channel members 112, 114. The inverted configuration of the stud 110 having the first and second elongated channel members 112, 114 is commonly known as a Z-girt stud, which is typically used in exterior walls of a structure for securing insulation batts (e.g., acoustical insulation) between adjacent studs, while minimizing a transfer of sound.

The wire matrix 116 may include a first angled continuous wire 118 and a second angled continuous wire 120 coupled to each other at intersection points 126, such as discussed with reference to FIGS. 1A-3. The first and second angled continuous wires 118, 120 include a plurality of apexes 122, 124 that are coupled to the first and second elongated channel members 112, 114, as exemplified by apex 122*b* and apex 124*a*, for example.

The first elongated channel member 112 may have a major face 130 and a first flange 132. The first flange 132 may be formed inwardly toward the wire matrix 116 at approximately a 90 degree angle (or non-zero angle) relative to the major face 130. The first flange 132 may include a pair of corrugated portions 138 extending longitudinally along a length of the first flange 132 for attachment to the wire matrix 116. Likewise, the second elongated channel member 114 may have a major face 134 and a first flange 136. The first flange 136 may be formed inwardly toward the wire matrix 116 at approximately a 90 degree angle (or non-zero angle) relative to the major face 134. The flange 136 may include a pair of corrugated portions 140 extending longitudinally along a length of the flange 136 for attachment to the wire matrix 116 on an opposing face of the wire matrix 116 relative to the corrugated portions 138 of the flange 132. As discussed elsewhere in the present disclosure, the plurality of apexes 122, 124 of the wire matrix 116 may be coupled to contact portions 139, 141 of the respective first flange 132, 136 alternatively along a length of the first and second elongated channel members 112, 114. Such attachment between the wire matrix 116 and the first and second elongated channel members 112, 114 may occur alternatively along the corrugated portions 138, 140, whether by spot welding, resistance welding, or other suitable attachment means.

According to some aspects, the apexes of the wire matrix 116 may be coupled to the first flange 132 of the first elongated channel member 112 and spatially separated from the major face 130 by a distance L. Likewise, the apexes of the wire matrix 116 may be coupled to the first flange 136 of the second elongated channel member 114 and spatially separated from the major face 134 by a distance L. This configuration may provide the same or similar advantages, as further discussed with reference to FIGS. 1A-3.

According to some aspects, the first and second elongated channel members 112, 114 may each include a second flange 142, 144. The second flange 142 of the first elongated channel member 112 may extend from the major face 130 inwardly and in an arc-shaped configuration, which may be achieved by rolling the flange inwardly. Likewise, the second flange 144 of the second elongated channel member 114 may extend from the major face 134 inwardly and in an arc-shaped configuration. Thus, the first and second elongated channel members 112, 114 each may have a J-shaped cross sectional profile. In some aspects, the arc-shaped second flanges 142, 144 can be formed from 45 degrees to almost 360 degrees relative to respective major faces 130, 134. The arc-shaped configuration provides the same or similar advantages discussed with reference to FIG. 3.

The Z-girt stud shown in FIG. 4 provides numerous advantages. Conventional Z-girt metal studs are typically formed of one continuous sheet of metal that is bent into a Z-shaped stud. Attached to sheet metal surfaces formed by the Z-shaped stud may be utility lines, fasteners, gang boxes, and other lines and devices. Thus, moisture from rain and snow that may leak into external walls can readily be trapped by the major faces of conventional Z-girt studs and the devices attached thereto, which can lead to heat losses, formation of mold, and corrosion, which poses safety and efficiency concerns. Conversely, the present disclosure provides a metal stud that permits moisture to more easily pass through portions of the stud and not be trapped by surfaces or components. This is achieved due to the plurality of longitudinal passages defined by the wire matrix, which allow increased air flow and allow moisture to drain substantially downwardly as opposed to being trapped on a planar surface, for example. Additionally, the contact portions between the wire matrix and the elongated channel members are raised such that moisture is allowed to pass through and quickly dry due to the reduced surface-to-surface contact between the wire matrix and the elongated channel members, as compared to available designs.

FIG. 5 shows a stud system 100 having a pair of lightweight metal studs according to one aspect of the present disclosure. The system 100 includes a first stud 10 and a second stud 10' positioned spatially apart from each other and against a wall 48, as with typical structural arrangements. The first stud 10 and the second stud 10' each include a first elongated channel member 12 and a second elongated channel member 14 positioned parallel to and spatially separated from each other. The first stud 10 includes a wire matrix 16 coupled to and positioned between the first elongated channel member 12 and the second elongated channel member 14 at various portions along the lengths of the members, such as described with reference to FIGS. 1A-3. The second stud 10' includes a wire matrix 116 coupled to and positioned between the first elongated channel member 12 and the second elongated channel member 14 at various portions along the length of the elongated channel members, such as described with reference to FIGS. 1A-3. The wire matrix 116 may include a pair of longitudinal wires 46 coupled to the wire matrix 116. The pair of longitudinal wires 46 may be parallel to each other and coupled to the wire matrix 116 along various intersection points. The pair of longitudinal wires 46 may be positioned spatially parallel to and between the first and second elongated channel members 12, 14. The longitudinal wires 46 may be secured for additional structural support. Importantly, the pair of longitudinal wires 46 defines a plurality of longitudinal passages 128 for positioning utility lines through the longitudinal passages 128. In this aspect, smaller utility lines, such as an electrical wire 52, can be positioned through the longitudinal passage 128 (or numerous longitudinal passages) to physically separate utility lines from each other and away from sharp edges of the first and second elongated channel members 12, 14 of the stud 10'.

Likewise, the wire matrix 16 of the stud 10 defines a plurality of longitudinal passages 28 along a central length of the wire matrix 16. The longitudinal passages 28 may partially or completely structurally support utility lines, such as the electrical wire 52 and a pipe 50. Additionally, the longitudinal passages 28 allow egress of utility lines to physically separate the utility lines from each other and away from sharp edges of the first and second elongated channel members 12, 14 to reduce or prevent damage to the lines and to increase safety.

While the metal stud is disclosed as employing two distinct continuous (e.g., single piece constructions) wire members, other implementations may employ wire members composed of distinct portions (e.g., a plurality of V-shaped or L-shaped portions) physically coupled to one another, for example via welding, to form an integral structure. As such implementations may be more difficult and expensive to manufacture and/or may have different strength and/or rigidity, these implementations may be less preferred than a single piece construction or continuous wire member.

Figure 10:
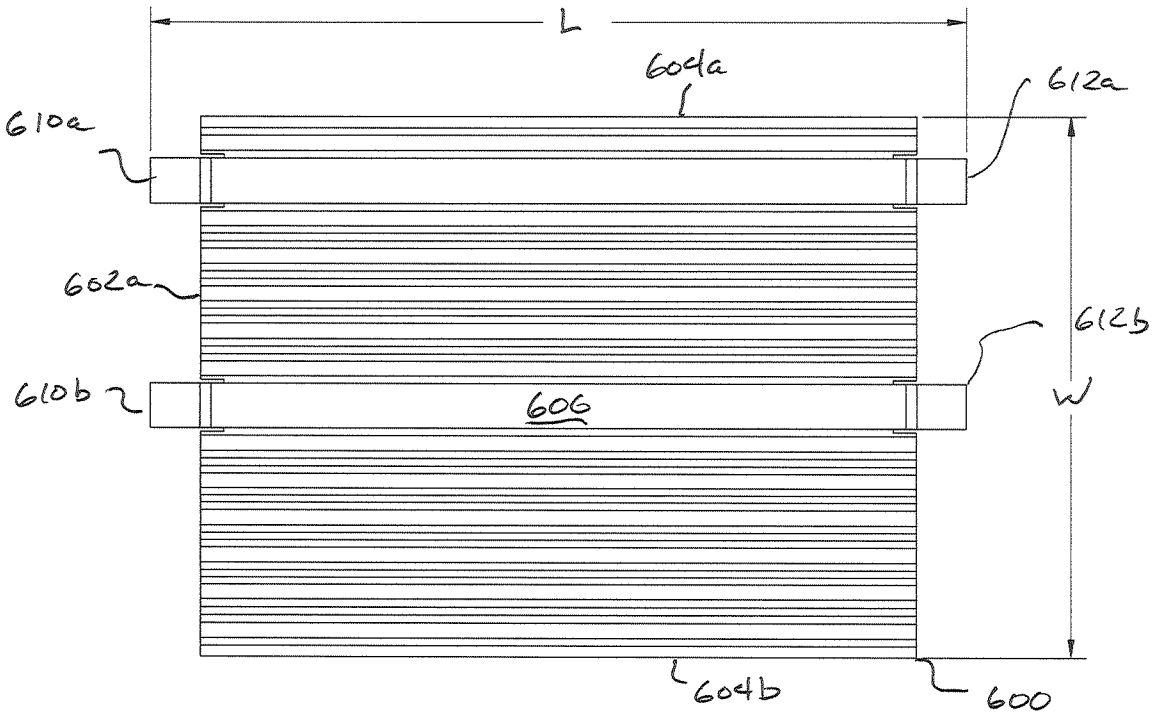
FIG. 10 top plan view of the reinforcement plate of FIG. 6 in a flattened configuration, prior to being folded to form upstanding portions or tabs.
Figure 11:
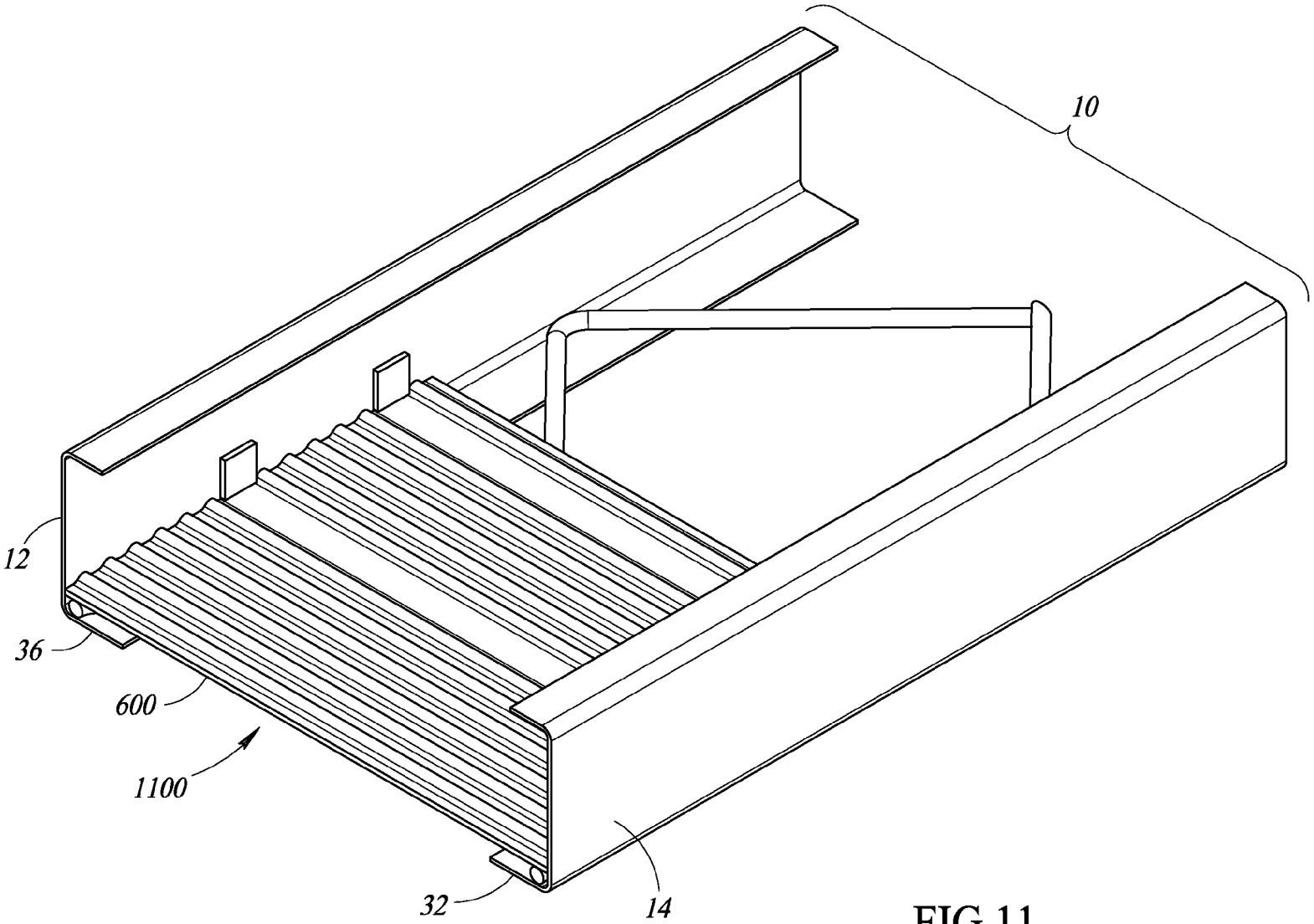
FIG. 11 is a top isometric view of a metal framing member including a metal stud and reinforcement plate physically coupled thereto proximate at least one end thereof, according to at least one illustrated embodiment.
Figure 12:
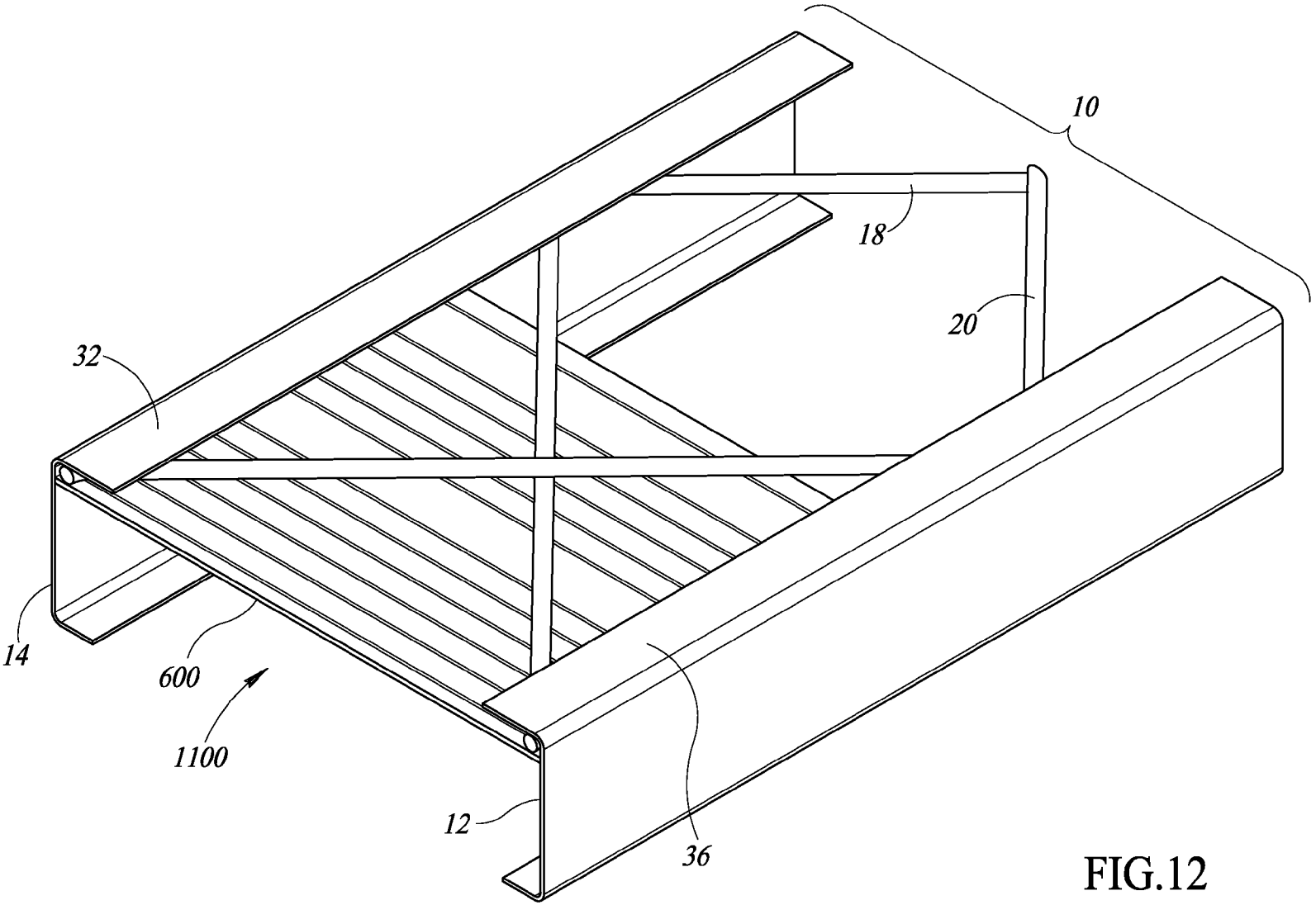
FIG. 12 is a bottom isometric view of the metal framing member of FIG. 12.
Figure 13:
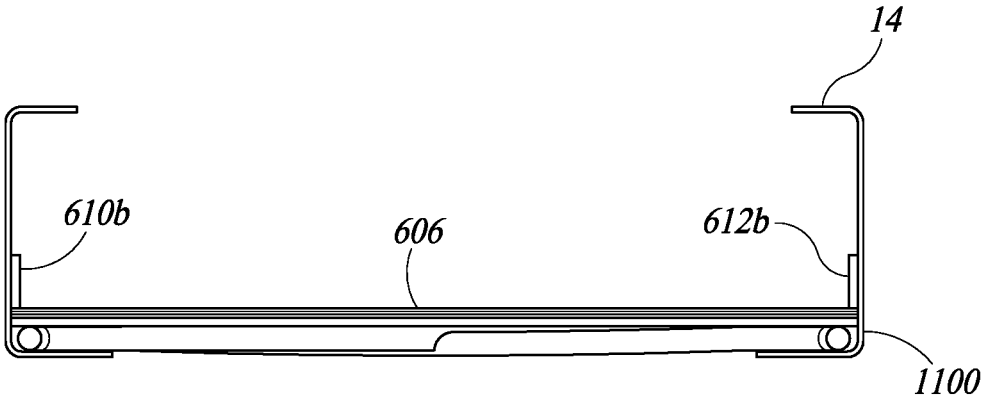
FIG. 13 is an end elevational view of the metal framing member of FIG. 12.
Figure 14:
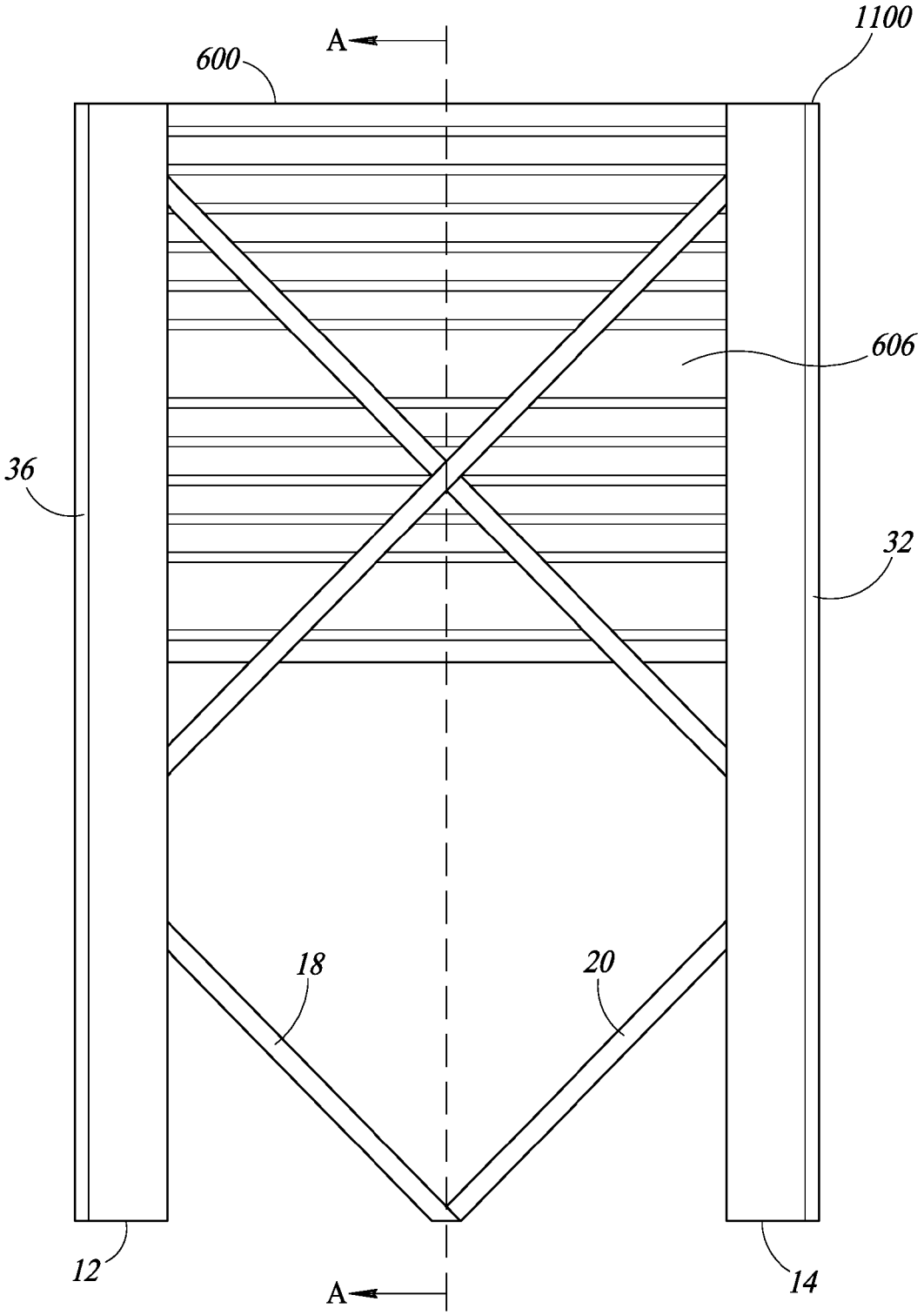
FIG. 14 is front plan view of the metal framing member of FIG. 12.
Figure 15:
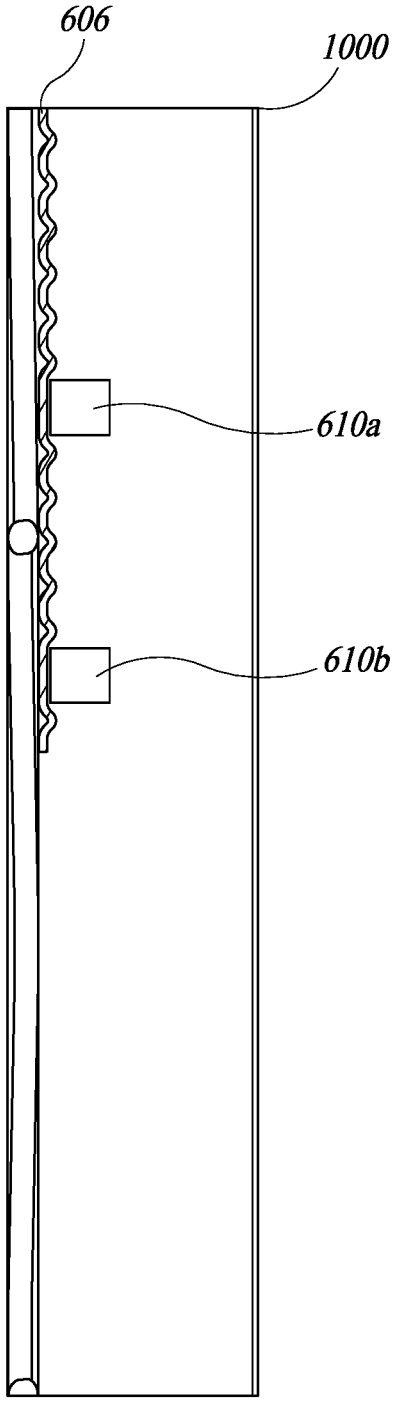
FIG. 15 is a cross-sectional view of the metal framing member of FIG. 12, taken along the section line A-A of FIG. 14.

FIGS. 6-10 show an reinforcement plate 600 for use with the metal stud to fabricate a metal framing member 1100 (FIGS. 10-14), according to at least one illustrated embodiment. In particular, FIG. 10 shows the reinforcement plate 600 in a flatten or unfolded configuration, while FIGS. 6-19 show the reinforcement plate 600 in a folded configuration.

The reinforcement plate 600 may have a rectangular profile, having a length L and a width W, and having a gauge or thickness of material G that is generally perpendicular to the profile and hence the length L and the width W. The reinforcement plate 600 has a first pair of opposed edges 602*a*, 602*b*, a second edge 602*b* of the first pair opposed to a first edge 602*a* of the first pair across the length L of the reinforcement plate 600. The reinforcement plate 600 has a second pair of opposed edges 604*a*, 604*b*, a second edge 604*b* of the second pair opposed to a first edge 604*a* of the second pair across the width W of the reinforcement plate 600.

Between the first and the second pair of opposed edges 602*a*, 602*b*, 604*a*, 604*b* is a center or plate portion 606 of the reinforcement plate 600. The center or plate portion 606 of the reinforcement plate 600 is preferably corrugated, having a plurality of ridges 608*a* and valleys 608*b* (only one of each called out for clarity of illustration), the ridges 608*a* and valleys 608*b* which extend between the first and the second edges 602*a*, 602*b* of the first pair of opposed edges, that is across the length L of the reinforcement plate 600. The ridges 608*a* and valleys 608*b* preferably repeat in a direction along which the first and the second edges 602*a*, 602*b* of the first of opposed extend, that is repeating along the width W of the reinforcement plate 600. The corrugations provide structural rigidity to the reinforcement plate 600. The pattern may be continuous, or as illustrated may be discontinuous, for example omitting ridges 608*a* and valleys 608*b* in sections between pairs of opposed tabs (e.g., opposed pair of tabs 610*a*, 612*a*, and opposed pair of tabs 610*b*, 612*b*).

The reinforcement plate 600 has at least one upstanding portion 610*a*-610*b* along the first edge 602*a* and at least one upstanding portion 612*a*-612*b* along the second edge 602*b*. The upstanding portions 610*a*, 610*b* may take the form of a respective pair of tabs that extend perpendicularly from the plate portion 606 along the first edge 602*a* and a respective pair of tabs that extend perpendicularly from the plate portion 606 along the second edge 602*b*.

As illustrated in FIGS. 11-15, the reinforcement plate 600 can be physically secured to the metal stud 10 via the at least one upstanding portion 610*a*, 610*b* along the first edge 602*a* and the at least one upstanding portion 612*a*, 612*b* along the second edge 602*b*. For example, the reinforcement plate 600 can be welded by welds to the metal stud 10 via the tabs 610*a*, 610*b*, 612*a*, 612*b* that extend perpendicularly from the plate portion 606. For instance, a first set welds can physically secure the respective pair of tabs 610*a*, 610*b* that extend perpendicularly from the plate portion 606 along the first edge 602*a* to the first flange 32 of the first elongated channel member 12, and a second set welds can physically secure the respective pair of tabs 612*a*, 612*b* that extend perpendicularly from the plate portion 606 along the second edge 602*b* to the first flange 36 of the second elongated channel member 14.

As best seen in FIG. 1A, a first reinforcement plate 600*a* may be fixed at least proximate or even at a first end 101*a* of the metal stud 10, and a second reinforcement plate 600*b* may be fixed at least proximate or even at a second end 101*b* of the metal stud 10

The various embodiments may provide a stud with enhance thermal efficiency over more conventional studs. While metals are typically classed as good thermal conductors, the studs described herein employ various structures and techniques to reduce conductive thermal transfer thereacross. For instance, the wire matrix, welds (e.g., resistance welds), and the weld points (e.g., at peaks) may contribute to the energy efficiency of the stud.

The various embodiments described above can be combined to provide further embodiments. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A metal framing member, comprising:

a metal stud having:

a first elongated channel member, the first elongated channel member having a respective major face having a respective first edge along a major length thereof and a respective second edge along the major length thereof, a respective first flange extending along the first edge at a non-zero angle to the respective major face of the first elongated channel member;

a second elongated channel member, the second elongated channel member having a respective major face having a respective first edge along a major length thereof and a respective second edge along the major length thereof, a respective first flange extending along the first edge at a non-zero angle to the respective major face of the second elongated channel member, and a respective second flange;

a first continuous wire member having a plurality of bends to form alternating apexes along a respective length thereof, the apexes of the first continuous wire member alternatively physically attached to the first and the second elongated channel members along at least a portion of the first and the second elongated channel members; and a second continuous wire member having a plurality of bends to form alternating apexes along a respective length thereof, the apexes of the second continuous wire member alternatively physically attached to the first and the second elongated channel members along at least a portion of the first and the second elongated channel members, the first and the second elongated channel members held in spaced apart parallel relation to one another by both of the first and the second wire members, with a longitudinal passage formed therebetween; the metal framing member further comprising:

at least a first reinforcement plate and at least a first resistance weld that physically couples the first reinforcement plate to the metal stud, the first reinforcement plate having a plate portion having a length, a width, a gauge, a first edge and a second edge, the second edge opposed from the first edge across the length of the plate portion, the length of the plate portion sized to interference fit between the first elongated channel member and the second elongated channel member, the reinforcement plate adjacent to the first and the second continuous wires within the first and the second elongated channel members.

2. The metal framing of claim 1 wherein the plate portion is corrugated.

3. The metal framing of claim 2 wherein the plate portion includes a plurality of ridges and valleys, the ridges and valleys which extend between the first and the second edges of the plates, and which repeat in a direction along which the first and the second edges extend.

4. The metal framing of claim 2 wherein the first reinforcement plate has at least one upstanding portion along the first edge and at least one upstanding portion along the second edge, and the first reinforcement plate is secured to the metal stud via the at least one upstanding portion along the first edge and the at least one upstanding portion along the second edge.

5. The metal framing of claim 2 wherein the first reinforcement plate has at least one upstanding portion along the first edge and at least one upstanding portion along the second edge, and the first resistance weld physically secures the at least one upstanding portion along the first edge to the metal stud, and a second resistance weld physically secures the at least one upstanding portion along the second edge to the metal stud.

6. The metal framing of claim 4 wherein the at least one upstanding portion along the first edge includes a respective pair of tabs that extend perpendicularly from the plate portion along the first edge and the at least one upstanding portion along the second edge includes a respective pair of tabs that extend perpendicularly from the plate portion along the second edge.

7. The metal framing of claim 6, further comprising a first set of resistance welds, including the first resistance weld, that physically secure the respective pair of tabs that extend perpendicularly from the plate portion along the first edge to the first flange of the first elongated channel member and a second set of resistance welds that physically secure the respective pair of tabs that extend perpendicularly from the plate portion along the second edge to the first flange of the second elongated channel member.

8. The metal framing of claim 1 wherein the first and the second wire members are physically attached to one another at each point at which the first and the second wire members cross one another.

9. The metal framing of claim 8 wherein each of the apexes of the second wire member is opposed to a respective one of the apexes of the first wire member across the longitudinal passage.

10. The metal framing of claim 1 wherein the first elongated channel member has a respective second flange that extends along the second edge at a non-zero angle to the respective major face of the first elongated channel member and the second elongated channel member has a respective second flange that extends along the second edge at a non-zero angle to the respective major face of the second elongated channel member.

11. The metal framing of claim 10 wherein the respective second flange of at least one of the first or the second elongated channel member is a rolled edge.

12. The metal framing of claim 1 wherein the first flange of at least one of the first or the second elongated channel member is corrugated, having a number of ridges or valleys extending along the major length of the first edge.

13. The metal framing of claim 12 wherein the first and the second continuous wires are physically attached to the ridges or the valleys of the respective first flange of at least one of the first and the second elongated channel member via welds and do not physically contact the respective major faces of at least one of the first or the second elongated channel member.

14. The metal framing of claim 1 wherein the first and the second continuous wires are physically attached to the respective first flange of both the first and the second elongated channel member via welds and do not physically contact the respective major faces of the first and the second elongated channel member.

15. The metal framing of claim 1, further comprising:

a first longitudinal wire member extending along the major length of the first channel member, spaced inwardly from the first channel member toward the second channel member; and a second longitudinal wire member extending along the major length of the second channel member, spaced inwardly from the second channel member toward the first channel member, and spaced apart from the first longitudinal wire member.

16. The metal framing of claim 1 wherein the first reinforcement plate is located at least proximate a first end of the metal stud, and further comprising:

at least a second reinforcement plate and at least a second resistance weld that physically couples the second reinforcement plate to the metal stud at least proximate a second end of the metal stud, the second reinforcement plate having a plate portion having a length, a width, a gauge, a first edge and a second edge, the second edge opposed from the first edge across the length of the plate portion.

17. A method of making a metal framing, the method comprising:

providing a first elongated channel member having a respective major face having a respective first edge along a major length thereof and a respective second edge along the major length thereof, a respective first flange extending along the first edge at a non-zero angle to the respective major face of the first elongated channel member, and a respective second flange extending along the second edge at a non-zero angle to the respective major face of the first elongated channel member;

providing a second elongated channel member having a respective major face having a respective first edge along a major length thereof and a respective second edge along the major length thereof, a respective first flange extending along the first edge at a non-zero angle to the respective major face of the second elongated channel member, and a respective second flange extending along the second edge at a non-zero angle to the respective major face of the second elongated channel member;

coupling the first and the second elongated channel member together with a first and a second continuous wire member each having a plurality of bends to form alternating apexes along a respective length thereof, the apexes of the first continuous wire member alternatively physically attached to the first and the second elongated channel members along at least a portion of the first and the second elongated channel members, and the apexes of the second continuous wire member alternatively physically attached to the first and the second elongated channel members along at least a portion of the first and the second elongated channel members;

providing at least a first reinforcement plate adjacent to the first and the second continuous wires within the first and the second elongated channel members, the first reinforcement plate having a plate portion having a length, a width, a gauge, a first edge and a second edge, the second edge opposed from the first edge across the length of the plate portion, the length of the plate portion sized to interference fit between the first elongated channel member and the second elongated channel member; and resistance welding the first reinforcement plate to the first elongated channel member and to the second elongated channel member at least proximate a first end of the first and the second elongated channel members.

18. The method of claim 17, further comprising:

providing at least a second reinforcement plate, the second reinforcement plate having a plate portion having a length, a width, a gauge, a first edge and a second edge, the second edge opposed from the first edge across the length of the plate portion; and resistance welding the second reinforcement plate to the first elongated channel member and to the second elongated channel member at least proximate a second end of the first and the second elongated channel members.

19. The method of claim 17 wherein the first reinforcement plate has at least one upstanding portion along the first edge and at least one upstanding portion along the second edge, and resistance welding the first reinforcement plate to the first elongated channel member and to the second elongated channel member includes resistance welding the at least one upstanding portion along the first edge to the first flange of the first elongated channel member and resistance welding the at least one upstanding portion along the second edge to the first flange of the second elongated channel member.

* * * * *